US010841727B2

(12) United States Patent
Audfray et al.

(10) Patent No.: US 10,841,727 B2
(45) Date of Patent: Nov. 17, 2020

(54) LOW-FREQUENCY INTERCHANNEL COHERENCE CONTROL

(71) Applicant: Magic Leap, Inc., Plantation, FL (US)

(72) Inventors: Remi Samuel Audfray, San Francisco, CA (US); Jean-Marc Jot, Aptos, CA (US)

(73) Assignee: Magic Leap, Inc., Plantation, FL (US)

( * ) Notice: Subject to any disclaimer, the term of this patent is extended or adjusted under 35 U.S.C. 154(b) by 0 days.

(21) Appl. No.: 16/439,540

(22) Filed: Jun. 12, 2019

(65) Prior Publication Data

US 2019/0379997 A1 Dec. 12, 2019

Related U.S. Application Data

(60) Provisional application No. 62/684,086, filed on Jun. 12, 2018.

(51) Int. Cl.

| | |
|---|---|
| ***H04S 7/00*** | (2006.01) |
| ***H04R 3/04*** | (2006.01) |
| ***H04R 5/033*** | (2006.01) |
| ***H04S 1/00*** | (2006.01) |
| ***G10K 15/08*** | (2006.01) |
| ***H04R 5/04*** | (2006.01) |

(52) U.S. Cl.

CPC ..... *H04S 7/307* (2013.01); *G10K 15/08* (2013.01); *H04R 3/04* (2013.01); *H04R 5/033* (2013.01); *H04R 5/04* (2013.01); *H04S 1/007* (2013.01); *H04S 2420/01* (2013.01)

(58) Field of Classification Search

USPC ..... 381/71.11, 94.3, 98, 99, 303, 367, 370, 381/402

See application file for complete search history.

(56) References Cited

U.S. PATENT DOCUMENTS

2004/0013271 A1 1/2004 Moorthy
2005/0190936 A1* 9/2005 Miura ..... H04S 1/002 381/309

(Continued)

FOREIGN PATENT DOCUMENTS

WO 2020076377 A2 4/2020

OTHER PUBLICATIONS

International Search Report and Written Opinion, dated Apr. 20, 2020, for PCT Application No. PCT/US19/36859, filed Jun. 12, 2019, twelve pages.

*Primary Examiner* — Yosef K Laekemariam
(74) *Attorney, Agent, or Firm* — Morrison & Foerster LLP

(57) ABSTRACT

A system and method for providing low interaural coherence at low frequencies is disclosed. In some embodiments, the system may include a reverberator and a low-frequency interaural coherence control system. The reverberator may include two sets of comb filters, one for the left ear output signal and one for the right ear output signal. The low-frequency interaural coherence control system can include a plurality of sections, each section can be configured to control a certain frequency range of the signals that propagate through the given section. The sections may include a left high-frequency section for the left ear output signal and a right high-frequency section for the right ear output signal. The sections may also include a shared low-frequency section that can output signals to be combined by combiners of the left and right high-frequency sections.

16 Claims, 23 Drawing Sheets

(56) References Cited

U.S. PATENT DOCUMENTS

| | | | | |
|---|---|---|---|---|
| 2006/0045294 | A1 | 3/2006 | Smyth | |
| 2011/0170721 | A1 | 7/2011 | Dickins | |
| 2014/0029775 | A1 | 1/2014 | Anderson | |
| 2014/0314238 | A1* | 10/2014 | Usher | H04R 3/04 381/17 |
| 2017/0230777 | A1 | 8/2017 | Seldess | |
| 2017/0325043 | A1* | 11/2017 | Jot | H04S 3/002 |

* cited by examiner

LOW-FREQUENCY INTERCHANNEL COHERENCE CONTROL

CROSS-REFERENCE TO RELATED APPLICATION

This application claims priority to U.S. Provisional Application No. 62/684,086, filed on Jun. 12, 2018, the contents of which are incorporated by reference herein in their entirety.

FIELD

This disclosure generally relates to low-frequency coherence between signals, for example, using a bass management type approach to force high coherence at low frequencies. In some embodiments, this disclosure is in the context of a binaural renderer where two signals are output from a room simulation algorithm.

BACKGROUND

Virtual environments are ubiquitous in computing environments, finding use in video games (in which a virtual environment may represent a game world); maps (in which a virtual environment may represent terrain to be navigated); simulations (in which a virtual environment may simulate a real environment); digital storytelling (in which virtual characters may interact with each other in a virtual environment); and many other applications. Modern computer users are generally comfortable perceiving, and interacting with, virtual environments. However, users' experiences with virtual environments can be limited by the technology for presenting virtual environments. For example, conventional displays (e.g., 2D display screens) and audio systems (e.g., fixed speakers) may be unable to realize a virtual environment in ways that create a compelling, realistic, and immersive experience.

Virtual reality ("VR"), augmented reality ("AR"), mixed reality ("MR"), and related technologies (collectively, "XR") share an ability to present, to a user of an XR system, sensory information corresponding to a virtual environment represented by data in a computer system. Such systems can offer a uniquely heightened sense of immersion and realism by combining virtual visual and audio cues with real sights and sounds. Accordingly, it can be desirable to present digital sounds to a user of an XR system in such a way that the sounds seem to be occurring—naturally, and consistently with the user's expectations of the sound—in the user's real environment. Generally speaking, users expect that virtual sounds will take on the acoustic properties of the real environment in which they are heard. For instance, a user of an XR system in a large concert hall will expect the virtual sounds of the XR system to have large, cavernous sonic qualities; conversely, a user in a small apartment will expect the sounds to be more dampened, close, and immediate. Additionally, users expect that virtual sounds will have inherent spatial effects. For example, a user standing at the front of the room will expect that virtual sounds originating from a source located close by appear to be coming from the front of the room, and virtual sounds originating from a source located far away appear to be coming from the back of the room. In this manner, the user can distinguish between, e.g., a person having an arm's reach conversion and music playing in the background.

Some artificial reverberators may use a frequency dependent matrix. The frequency dependent matrix can be a 2×2 matrix that injects a left reverberator output signal and a right reverberator output signal, where the right reverberator output signal is a scaled copy of the sum of the left reverberator output signal and the right reverberator output signal. In some embodiments, using the frequency dependent 2×2 matrix may have a detrimental effect on the timbre quality of the left reverberator output signal and the right reverberator output signal at certain frequencies due to destructive and constructive interferences.

Therefore, alternative systems and methods for achieving high interaural coherence at low frequencies are desired. Additionally or alternatively, systems and methods for achieving low interaural coherence at mid and/or high frequencies are desired.

BRIEF SUMMARY

Systems and methods for providing low interaural coherence at low frequencies are disclosed. In some embodiments, a system may include a reverberator and a low-frequency interaural coherence control system. The reverberator may include two sets of comb filters, one for a left ear output signal and one for a right ear output signal.

The low-frequency interaural coherence control system can include a plurality of sections; each section can be configured to control a certain frequency range of the signals that propagate through that section. A section may include a left high-frequency section for the left ear output signal and a right high-frequency section for the right ear output signal. A section may also include a shared low-frequency section that can output signals to be combined by combiners of the left and right high-frequency sections.

The low-frequency interaural coherence control system can include a plurality of filters, and optionally, a delay. The plurality of filters may include one or more high-pass filters, one or more all-pass filters, and/or a low pass filter. In some embodiments, the low-frequency interaural coherence control system can include one or more high-frequency processing units.

In some embodiments, one output signal (e.g., the left ear output signal) may be the same as an input signal, and thus, it may not undergo any processing.

In some embodiments, an absorption coefficient with each delay unit in the network may be inserted to control the reverberation decay time.

DETAILED DESCRIPTION

In the following description of examples, reference is made to the accompanying drawings which form a part hereof, and in which it is shown by way of illustration specific examples that can be practiced. It is to be understood that other examples can be used and structural changes can be made without departing from the scope of the disclosed examples.

Example Wearable System

Figure 1:
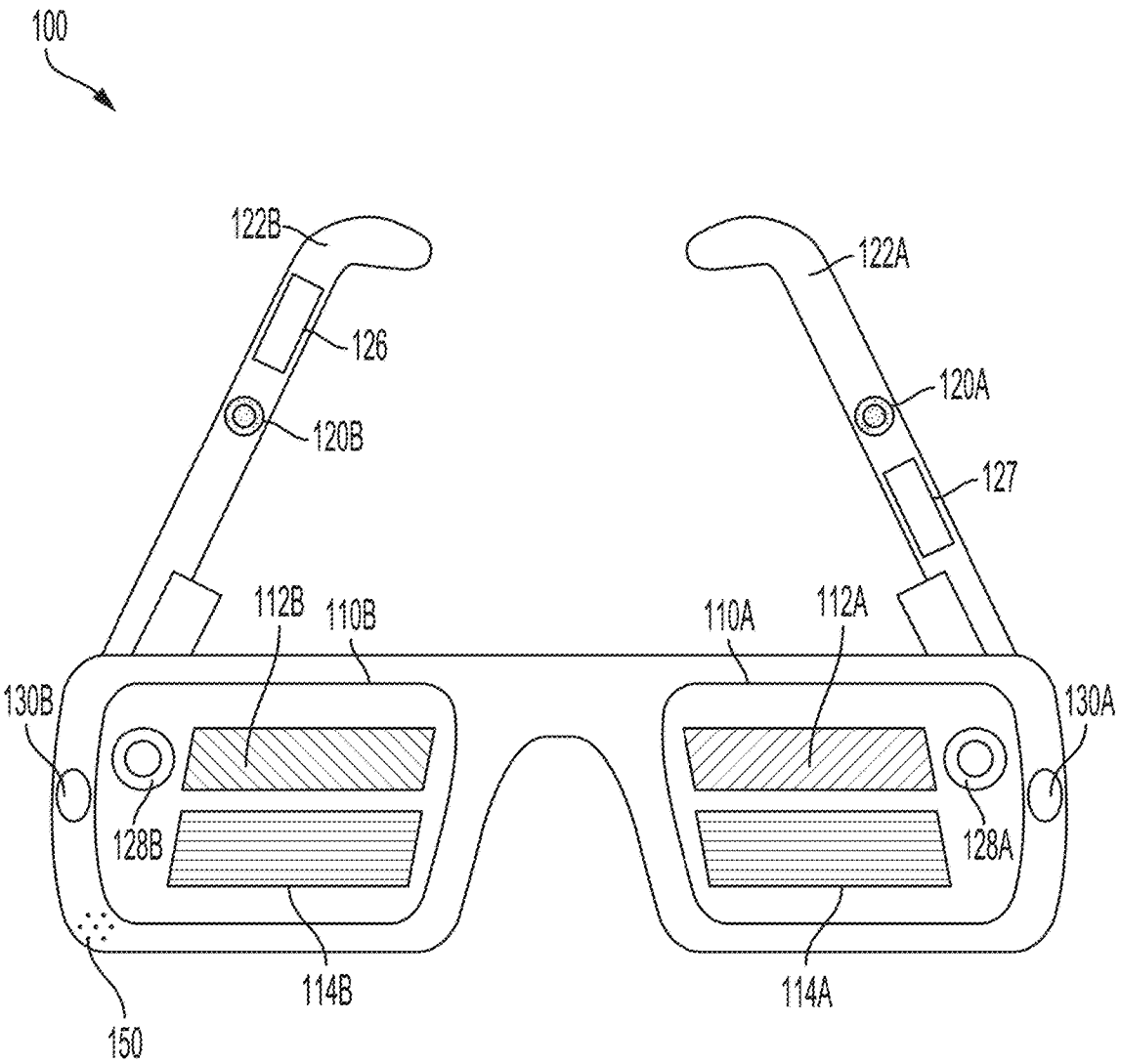
FIG. 1 illustrates an example wearable head device 100 configured to be worn on the head of a user, according to some embodiments.

FIG. 1 illustrates an example wearable head device 100 configured to be worn on the head of a user. Wearable head device 100 may be part of a broader wearable system that comprises one or more components, such as a head device (e.g., wearable head device 100), a handheld controller (e.g., handheld controller 200 described below), and/or an auxiliary unit (e.g., auxiliary unit 300 described below). In some examples, wearable head device 100 can be used for virtual reality, augmented reality, or mixed reality systems or applications. Wearable head device 100 can comprise one or more displays, such as displays 110A and 110B (which may comprise left and right transmissive displays, and associated components for coupling light from the displays to the user's eyes, such as orthogonal pupil expansion (OPE) grating sets 112A/112B and exit pupil expansion (EPE) grating sets 114A/114B); left and right acoustic structures, such as speakers 120A and 120B (which may be mounted on temple arms 122A and 122B, and positioned adjacent to the user's left and right ears, respectively); one or more sensors such as infrared sensors, accelerometers, GPS units, inertial measurement units (IMU) (e.g. IMU 126), acoustic sensors (e.g., microphone 150); orthogonal coil electromagnetic receivers (e.g., receiver 127 shown mounted to the left temple arm 122A); left and right cameras (e.g., depth (time-of-flight) cameras 130A and 130B) oriented away from the user; and left and right eye cameras oriented toward the user (e.g., for detecting the user's eye movements)(e.g., eye cameras 128 and 128B). However, wearable head device 100 can incorporate any suitable display technology, and any suitable number, type, or combination of sensors or other components without departing from the scope of the invention. In some examples, wearable head device 100 may incorporate one or more microphones 150 configured to detect audio signals generated by the user's voice; such microphones may be positioned in a wearable head device adjacent to the user's mouth. In some examples, wearable head device 100 may incorporate networking features (e.g., Wi-Fi capability) to communicate with other devices and systems, including other wearable systems. Wearable head device 100 may further include components such as a battery, a processor, a memory, a storage unit, or various input devices (e.g., buttons, touchpads); or may be coupled to a handheld controller (e.g., handheld controller 200) or an auxiliary unit (e.g., auxiliary unit 300) that comprises one or more such components. In some examples, sensors may be configured to output a set of coordinates of the head-mounted unit relative to the user's environment, and may provide input to a processor performing a Simultaneous Localization and Mapping (SLAM) procedure and/or a visual odometry algorithm. In some examples, wearable head device 100 may be coupled to a handheld controller 200, and/or an auxiliary unit 300, as described further below.

Figure 2:
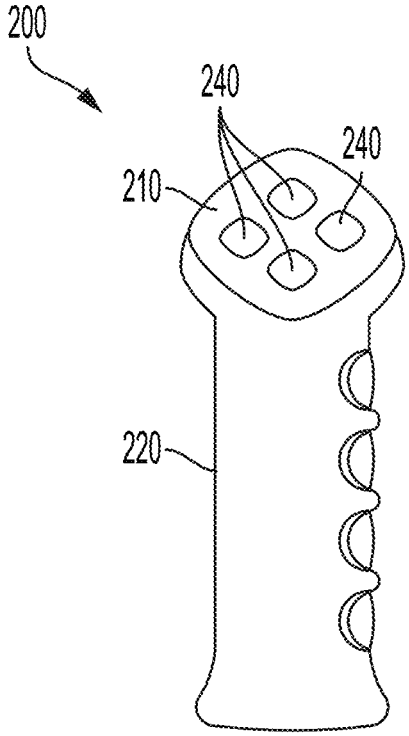
FIG. 2 illustrates an example mobile handheld controller component 200 of an example wearable system, according to some embodiments.

FIG. 2 illustrates an example mobile handheld controller component 200 of an example wearable system. In some examples, handheld controller 200 may be in wired or wireless communication with wearable head device 100 and/or auxiliary unit 300 described below. In some examples, handheld controller 200 includes a handle portion 220 to be held by a user, and one or more buttons 240 disposed along a top surface 210. In some examples, handheld controller 200 may be configured for use as an optical tracking target; for example, a sensor (e.g., a camera or other optical sensor) of wearable head device 100 can be configured to detect a position and/or orientation of handheld controller 200—which may, by extension, indicate a position and/or orientation of the hand of a user holding handheld controller 200. In some examples, handheld controller 200 may include a processor, a memory, a storage unit, a display, or one or more input devices, such as described above. In some examples, handheld controller 200 includes one or more sensors (e.g., any of the sensors or tracking components described above with respect to wearable head device 100). In some examples, sensors can detect a position or orientation of handheld controller 200 relative to wearable head device 100 or to another component of a wearable system. In some examples, sensors may be positioned in handle portion 220 of handheld controller 200, and/or may be mechanically coupled to the handheld controller. Handheld controller 200 can be configured to provide one or more output signals, corresponding, for example, to a pressed state of the buttons 240; or a position, orientation, and/or motion of the handheld controller 200 (e.g., via an IMU). Such output signals may be used as input to a processor of wearable head device 100, to auxiliary unit 300, or to another component of a wearable system. In some examples, handheld controller 200 can include one or more microphones to detect sounds (e.g., a user's speech, environmental sounds), and in some cases provide a signal corresponding to the detected sound to a processor (e.g., a processor of wearable head device 100).

Figure 3:
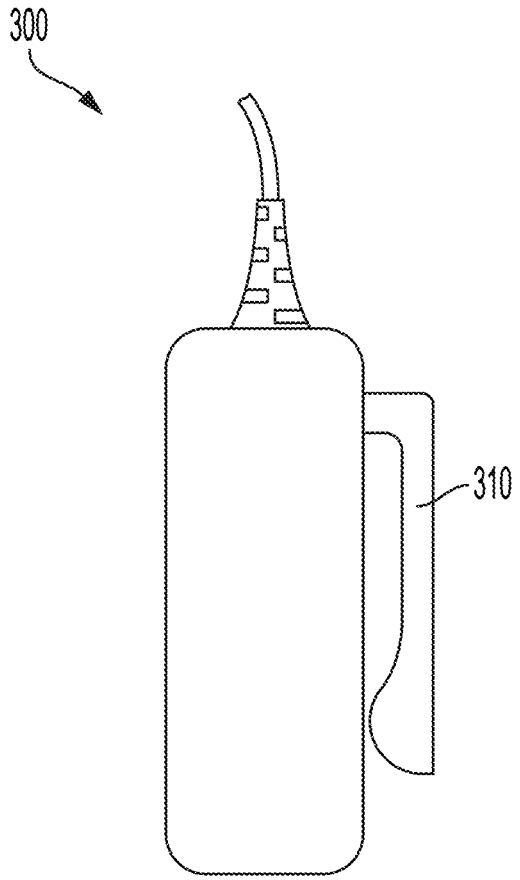
FIG. 3 illustrates an example auxiliary unit 300 of an example wearable system, according to some embodiments.

FIG. 3 illustrates an example auxiliary unit 300 of an example wearable system. In some examples, auxiliary unit 300 may be in wired or wireless communication with wearable head device 100 and/or handheld controller 200. The auxiliary unit 300 can include a battery to provide energy to operate one or more components of a wearable system, such as wearable head device 100 and/or handheld controller 200 (including displays, sensors, acoustic structures, processors, microphones, and/or other components of wearable head device 100 or handheld controller 200). In some examples, auxiliary unit 300 may include a processor, a memory, a storage unit, a display, one or more input devices, and/or one or more sensors, such as described above. In some examples, auxiliary unit 300 includes a clip 310 for attaching the auxiliary unit to a user (e.g., a belt worn by the user). An advantage of using auxiliary unit 300 to house one or more components of a wearable system is that doing so may allow large or heavy components to be carried on a user's waist, chest, or back—which are relatively well-suited to support large and heavy objects—rather than mounted to the user's head (e.g., if housed in wearable head device 100) or carried by the user's hand (e.g., if housed in handheld controller 200). This may be particularly advantageous for relatively heavy or bulky components, such as batteries.

Figure 4:
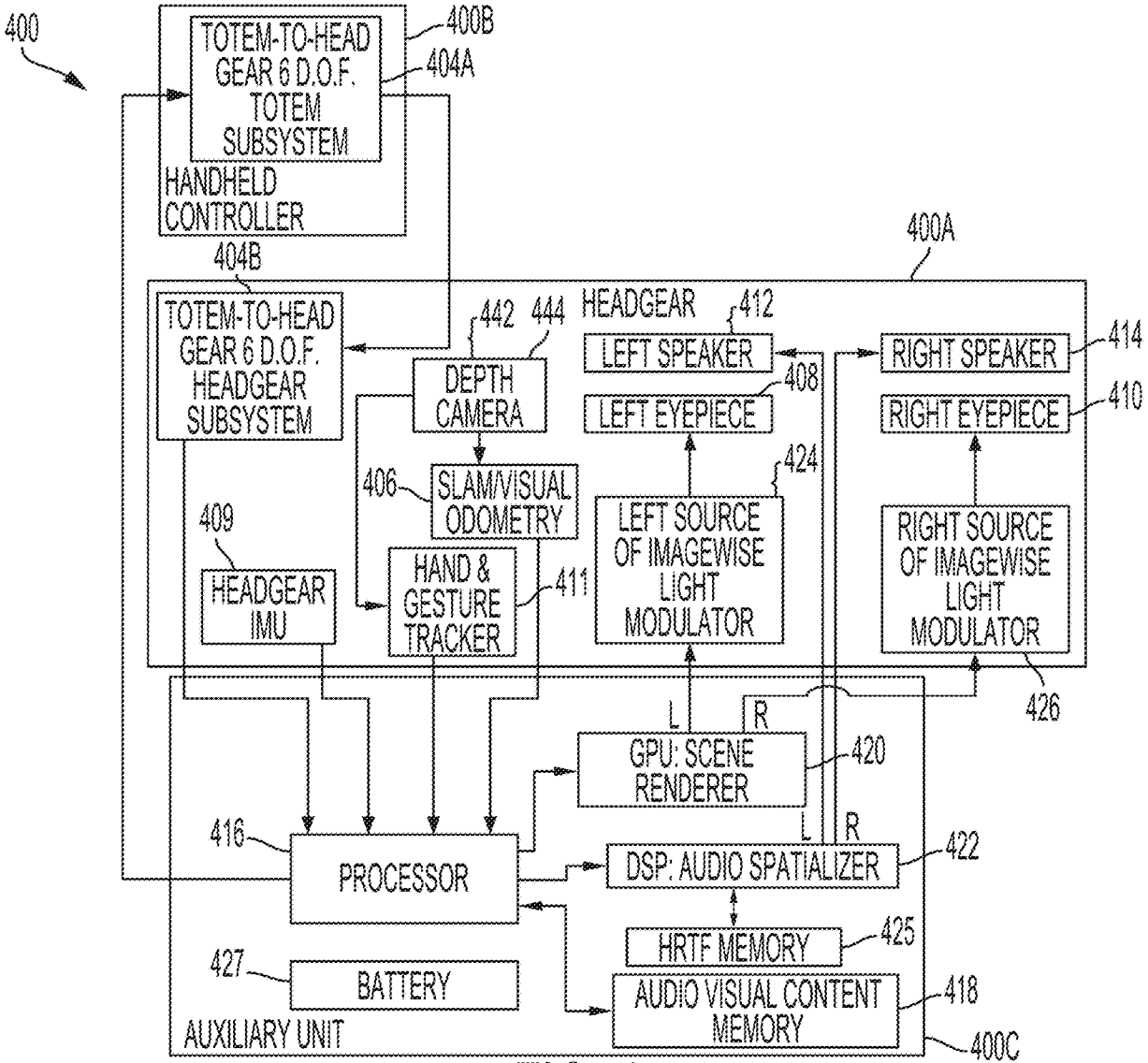
FIG. 4 illustrates an example functional block diagram that may correspond to an example wearable system, according to some embodiments.

FIG. 4 shows an example functional block diagram that may correspond to an example wearable system 400, such as may include example wearable head device 100, handheld controller 200, and auxiliary unit 300 described above. In some examples, the wearable system 400 could be used for virtual reality, augmented reality, or mixed reality applications. As shown in FIG. 4, wearable system 400 can include example handheld controller 400B, referred to here as a "totem" (and which may correspond to handheld controller 200 described above); the handheld controller 400B can include a totem-to-headgear six degree of freedom (6DOF) totem subsystem 404A. Wearable system 400 can also include example wearable head device 400A (which may correspond to wearable headgear device 100 described above); the wearable head device 400A includes a totem-to-headgear 6DOF headgear subsystem 404B. In the example, the 6DOF totem subsystem 404A and the 6DOF headgear subsystem 404B cooperate to determine six coordinates (e.g., offsets in three translation directions and rotation along three axes) of the handheld controller 400B relative to the wearable head device 400A. The six degrees of freedom may be expressed relative to a coordinate system of the wearable head device 400A. The three translation offsets may be expressed as X, Y, and Z offsets in such a coordinate system, as a translation matrix, or as some other representation. The rotation degrees of freedom may be expressed as sequence of yaw, pitch, and roll rotations; as vectors; as a rotation matrix; as a quaternion; or as some other representation. In some examples, one or more depth cameras 444 (and/or one or more non-depth cameras) included in the wearable head device 400A; and/or one or more optical targets (e.g., buttons 240 of handheld controller 200 as described above, or dedicated optical targets included in the handheld controller) can be used for 6DOF tracking. In some examples, the handheld controller 400B can include a camera, as described above; and the headgear 400A can include an optical target for optical tracking in conjunction with the camera. In some examples, the wearable head device 400A and the handheld controller 400B each include a set of three orthogonally oriented solenoids which are used to wirelessly send and receive three distinguishable signals. By measuring the relative magnitude of the three distinguishable signals received in each of the coils used for receiving, the 6DOF of the handheld controller 400B relative to the wearable head device 400A may be determined. In some examples, 6DOF totem subsystem 404A can include an Inertial Measurement Unit (IMU) that is useful to provide improved accuracy and/or more timely information on rapid movements of the handheld controller 400B.

In some examples involving augmented reality or mixed reality applications, it may be desirable to transform coordinates from a local coordinate space (e.g., a coordinate space fixed relative to wearable head device 400A) to an inertial coordinate space, or to an environmental coordinate space. For instance, such transformations may be necessary for a display of wearable head device 400A to present a virtual object at an expected position and orientation relative to the real environment (e.g., a virtual person sitting in a real chair, facing forward, regardless of the position and orientation of wearable head device 400A), rather than at a fixed position and orientation on the display (e.g., at the same position in the display of wearable head device 400A). This can maintain an illusion that the virtual object exists in the real environment (and does not, for example, appear positioned unnaturally in the real environment as the wearable head device 400A shifts and rotates). In some examples, a compensatory transformation between coordinate spaces can be determined by processing imagery from the depth cameras 444 (e.g., using a Simultaneous Localization and Mapping (SLAM) and/or visual odometry procedure) in order to determine the transformation of the wearable head device 400A relative to an inertial or environmental coordinate system. In the example shown in FIG. 4, the depth cameras 444 can be coupled to a SLAM/visual odometry block 406 and can provide imagery to block 406. The SLAM/visual odometry block 406 implementation can include a processor configured to process this imagery and determine a position and orientation of the user's head, which can then be used to identify a transformation between a head coordinate space and a real coordinate space. Similarly, in some examples, an additional source of information on the user's head pose and location is obtained from an IMU 409 of wearable head device 400A. Information from the IMU 409 can be integrated with information from the SLAM/visual odometry block 406 to provide improved accuracy and/or more timely information on rapid adjustments of the user's head pose and position.

In some examples, the depth cameras 444 can supply 3D imagery to a hand gesture tracker 411, which may be implemented in a processor of wearable head device 400A. The hand gesture tracker 411 can identify a user's hand gestures, for example, by matching 3D imagery received from the depth cameras 444 to stored patterns representing hand gestures. Other suitable techniques of identifying a user's hand gestures will be apparent.

In some examples, one or more processors 416 may be configured to receive data from headgear subsystem 404B, the IMU 409, the SLAM/visual odometry block 406, depth cameras 444, a microphone (not shown); and/or the hand gesture tracker 411. The processor 416 can also send and receive control signals from the 6DOF totem system 404A. The processor 416 may be coupled to the 6DOF totem system 404A wirelessly, such as in examples where the handheld controller 400B is untethered. Processor 416 may further communicate with additional components, such as an audio-visual content memory 418, a Graphical Processing Unit (GPU) 420, and/or a Digital Signal Processor (DSP) audio spatializer 422. The DSP audio spatializer 422 may be coupled to a Head Related Transfer Function (HRTF) memory 425. The GPU 420 can include a left channel output coupled to the left source of imagewise modulated light 424 and a right channel output coupled to the right source of imagewise modulated light 426. GPU 420 can output stereoscopic image data to the sources of imagewise modulated light 424, 426. The DSP audio spatializer 422 can output audio to a left speaker 412 and/or a right speaker 414. The DSP audio spatializer 422 can receive input from processor 416 indicating a direction vector from a user to a virtual sound source (which may be moved by the user, e.g., via the handheld controller 400B). Based on the direction vector, the DSP audio spatializer 422 can determine a corresponding HRTF (e.g., by accessing a HRTF, or by interpolating multiple HRTFs). The DSP audio spatializer 422 can then apply the determined HRTF to an audio signal, such as an audio signal corresponding to a virtual sound generated by a virtual object. This can enhance the believability and realism of the virtual sound, by incorporating the relative position and orientation of the user relative to the virtual sound in the mixed reality environment—that is, by presenting a virtual sound that matches a user's expectations of what that virtual sound would sound like if it were a real sound in a real environment.

In some examples, such as shown in FIG. 4, one or more of processor 416, GPU 420, DSP audio spatializer 422, HRTF memory 425, and audio/visual content memory 418 may be included in an auxiliary unit 400C (which may correspond to auxiliary unit 300 described above). The auxiliary unit 400C may include a battery 427 to power its components and/or to supply power to wearable head device 400A and/or handheld controller 400B. Including such components in an auxiliary unit, which can be mounted to a user's waist, can limit the size and weight of wearable head device 400A, which can in turn reduce fatigue of a user's head and neck.

While FIG. 4 presents elements corresponding to various components of an example wearable system 400, various other suitable arrangements of these components will become apparent to those skilled in the art. For example, elements presented in FIG. 4 as being associated with auxiliary unit 400C could instead be associated with wearable head device 400A or handheld controller 400B. Furthermore, some wearable systems may forgo entirely a handheld controller 400B or auxiliary unit 400C. Such changes and modifications are to be understood as being included within the scope of the disclosed examples.

Mixed Reality Environment

Like all people, a user of a mixed reality system exists in a real environment—that is, a three-dimensional portion of the "real world," and all of its contents, that are perceptible by the user. For example, a user perceives a real environment using one's ordinary human senses—sight, sound, touch, taste, smell—and interacts with the real environment by moving one's own body in the real environment. Locations in a real environment can be described as coordinates in a coordinate space; for example, a coordinate can comprise latitude, longitude, and elevation with respect to sea level; distances in three orthogonal dimensions from a reference point; or other suitable values. Likewise, a vector can describe a quantity having a direction and a magnitude in the coordinate space.

A computing device can maintain, for example in a memory associated with the device, a representation of a virtual environment. As used herein, a virtual environment is a computational representation of a three-dimensional space. A virtual environment can include representations of any object, action, signal, parameter, coordinate, vector, or other characteristic associated with that space. In some examples, circuitry (e.g., a processor) of a computing device can maintain and update a state of a virtual environment; that is, a processor can determine at a first time, based on data associated with the virtual environment and/or input provided by a user, a state of the virtual environment at a second time. For instance, if an object in the virtual environment is located at a first coordinate at time, and has certain programmed physical parameters (e.g., mass, coefficient of friction); and an input received from user indicates that a force should be applied to the object in a direction vector; the processor can apply laws of kinematics to determine a location of the object at time using basic mechanics. The processor can use any suitable information known about the virtual environment, and/or any suitable input, to determine a state of the virtual environment at a time. In maintaining and updating a state of a virtual environment, the processor can execute any suitable software, including software relating to the creation and deletion of virtual objects in the virtual environment; software (e.g., scripts) for defining behavior of virtual objects or characters in the virtual environment; software for defining the behavior of signals (e.g., audio signals) in the virtual environment; software for creating and updating parameters associated with the virtual environment; software for generating audio signals in the virtual environment; software for handling input and output; software for implementing network operations; software for applying asset data (e.g., animation data to move a virtual object over time); or many other possibilities.

Output devices, such as a display or a speaker, can present any or all aspects of a virtual environment to a user. For example, a virtual environment may include virtual objects (which may include representations of inanimate objects; people; animals; lights; etc.) that may be presented to a user. A processor can determine a view of the virtual environment (for example, corresponding to a "camera" with an origin coordinate, a view axis, and a frustum); and render, to a display, a viewable scene of the virtual environment corresponding to that view. Any suitable rendering technology may be used for this purpose. In some examples, the viewable scene may include only some virtual objects in the virtual environment, and exclude certain other virtual objects. Similarly, a virtual environment may include audio aspects that may be presented to a user as one or more audio signals. For instance, a virtual object in the virtual environment may generate a sound originating from a location coordinate of the object (e.g., a virtual character may speak or cause a sound effect); or the virtual environment may be associated with musical cues or ambient sounds that may or may not be associated with a particular location. A processor can determine an audio signal corresponding to a "listener" coordinate—for instance, an audio signal corresponding to a composite of sounds in the virtual environment, and mixed and processed to simulate an audio signal that would be heard by a listener at the listener coordinate—and present the audio signal to a user via one or more speakers.

Because a virtual environment exists only as a computational structure, a user cannot directly perceive a virtual environment using one's ordinary senses. Instead, a user can perceive a virtual environment only indirectly, as presented to the user, for example by a display, speakers, haptic output devices, etc. Similarly, a user cannot directly touch, manipulate, or otherwise interact with a virtual environment; but can provide input data, via input devices or sensors, to a processor that can use the device or sensor data to update the virtual environment. For example, a camera sensor can provide optical data indicating that a user is trying to move an object in a virtual environment, and a processor can use that data to cause the object to respond accordingly in the virtual environment.

Digital Reverberation and Environmental Audio Processing

A XR system can present audio signals that appear, to a user, to originate at a sound source with an origin coordinate, and travel in a direction of an orientation vector in the system. The user may perceive these audio signals as if they were real audio signals originating from the origin coordinate of the sound source and traveling along the orientation vector.

In some cases, audio signals may be considered virtual in that they correspond to computational signals in a virtual environment, and do not necessarily correspond to real sounds in the real environment. However, virtual audio signals can be presented to a user as real audio signals detectable by the human ear, for example as generated via speakers 120A and 120B of wearable head device 100 in FIG. 1.

Some virtual or mixed reality environments suffer from a perception that the environments do not feel real or authentic. One reason for this perception is that audio and visual cues do not always match each other in virtual environments. The entire virtual experience may feel fake and inauthentic, in part because it does not comport with our own expectations based on real world interactions. It is desirable to improve the user's experience by presenting audio signals that appear to realistically interact—even in subtle ways—with objects in the user's environment. The more consistent such audio signals are with our own expectations, based on real world experience, the more immersive and engaging the user's experience will be.

Digital reverberators (also referred to as artificial reverberators) may be used in audio and music signal processing. For example, a reverberator with a two-channel stereo output may produce a left ear signal and a right ear signal that are mutually uncorrelated. Mutually uncorrelated signals may be suitable for producing a diffuse reverberation effect in conventional stereo loudspeaker playback configuration. Uncorrelated reverberator output signals in a binaural audio playback system where the left output signal and the right output signal are transmitted separately to each ear may produce an unnatural effect. On the other hand, in a natural diffuse reverberant sound field, signals at a left ear and a right ear are highly coherent at low frequencies.

Figure 5B:
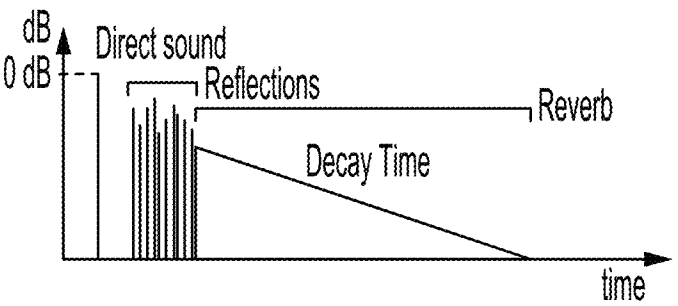
FIG. 5B illustrates an example impulse response between the input and one of the outputs of the binaural audio playback system of FIG. 5A.
Figure 5A:
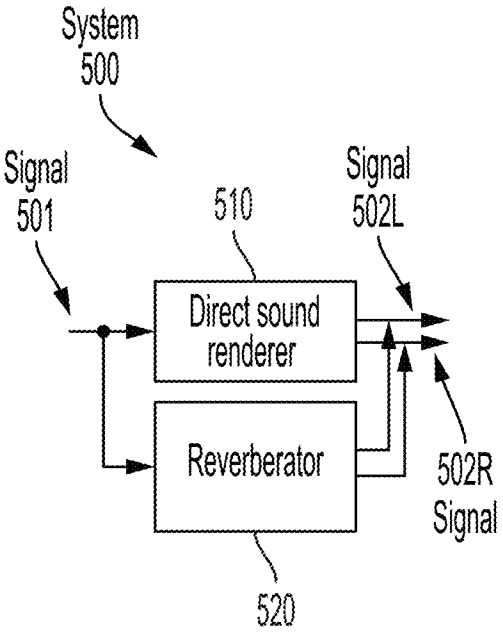
FIG. 5A illustrates an example binaural audio playback system in which a left output signal and a right output signal are transmitted separately to each ear.

FIG. 5A illustrates an example binaural audio playback system where a left output signal and a right output signal are transmitted separately to each ear. System 500 may be a binaural playback system that includes a direct sound renderer 510 and a reverberator 520. As shown in the figure, the system 500 may include separate direct sound rendered and reverberator energy paths. That is, signal 501 may be an input signal to the system 500. The signal 501 may be input to both the direct sound renderer 510 and the reverberator 520. The outputs from the direct sound renderer 510 and the reverberator 520 may combine to result in an output signal 502L (e.g., the left output signal) separate from the output signal 502R (e.g., the right output signal).

FIG. 5B illustrates an example impulse response between the input and one of the outputs of the binaural audio playback system of FIG. 5A. As shown in the figure, a direct sound is followed by reflections and reverberations; the reverberations may experience a decay that occurs naturally over time as they are attenuated by the environment.

Some artificial reverberators may use a frequency dependent matrix. The frequency dependent matrix can be a 2×2 matrix that injects a left reverberator output signal and a right reverberator output signal, where the right reverberator output signal is a scaled copy of the sum of the left reverberator output signal and the right reverberator output signal. In some embodiments, using the frequency dependent 2×2 matrix may have a detrimental effect on the timbre quality of the left reverberator output signal and the right reverberator output signal at certain frequencies due to destructive and constructive interferences. As such, the output signals may produce an unnatural effect at certain frequencies.

Target Interaural Coherence Features

Figure 6:
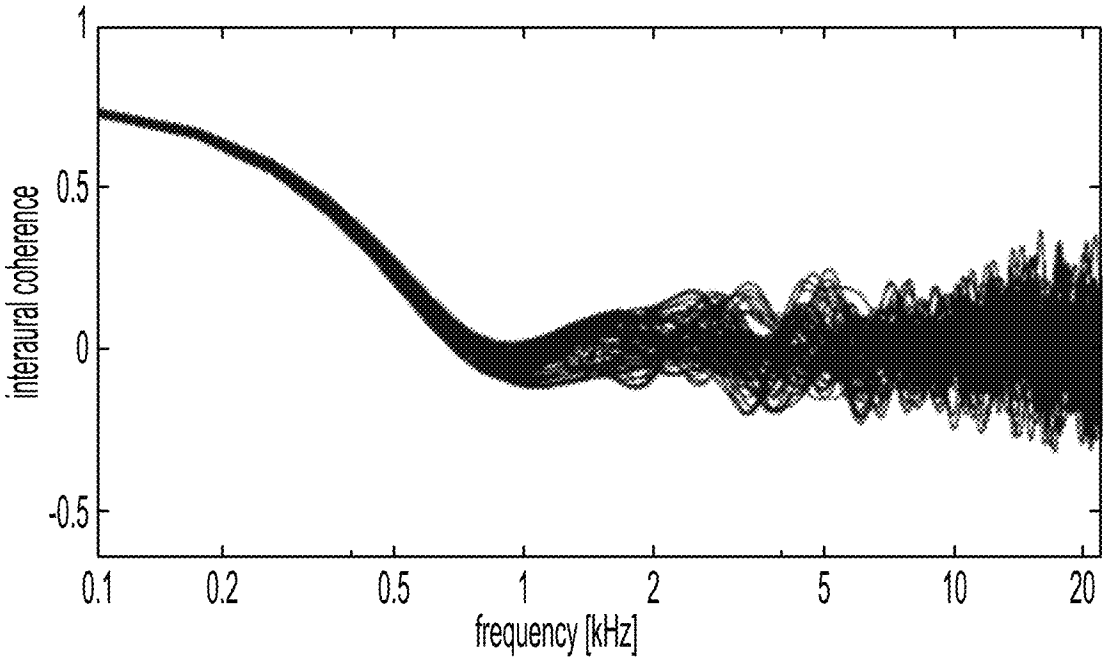
FIG. 6 illustrates a frequency dependent interaural coherence in a measured binaural room impulse response reverberation tail, according to some embodiments.

Interaural coherence is a measure of coherence between a left ear signal and a right ear signal in a binaural room impulse response (BRIR). The BRIR may reflect the influence a room may have on the acoustics. Similarly, interchannel coherence is a measure of coherence between a first channel signal and a second channel signal. The interaural coherence tends to be high at low frequencies, and low at high frequencies in BRIRs measured on individuals in a room. In other words, when analyzing measurements on individuals in a room, interaural coherence computed on a late reverberation decay may approach a diffuse field response of spaced omni microphone recordings, for example, as illustrated in FIG. 6. FIG. 6 illustrates a frequency dependent interaural coherence in a measured BRIR reverberation tail, according to some embodiments.

An interaural coherence target may be derived, for example, as a function of frequency. In some embodiments, it may be desired to achieve high interaural coherence (e.g., a high coherence between a left ear signal and a right ear signal) at low frequencies, and low interaural coherence (e.g., a low coherence between a left ear signal and a right ear signal) at mid and/or high frequencies.

Reverberation algorithms (which may be implemented using reverberators) may create output signals that are decorrelated between a left ear and a right ear. Controlling the interaural coherence at low frequencies may result in a more realistic room simulation effect for playback, for example, on a wearable head device, that transmits left ear signals and right ear signals separately (e.g., via separate left and right speakers directed at the left ear and the right ear, respectively).

Example Low-frequency Interaural Coherence Control

In some embodiments, uncorrelated output signals may be produced using a reverberation algorithm (which may be implemented using reverberators). The reverberation algorithm may, for example, include parallel comb filters with different delays for each ear (e.g., a left ear and a right ear), thereby producing different signals for the left ear and the right ear that may be substantially decorrelated from one another. In some embodiments, this may provide low interaural coherence at high frequencies, but may not provide high interaural coherence at low frequencies.

Figure 7A:
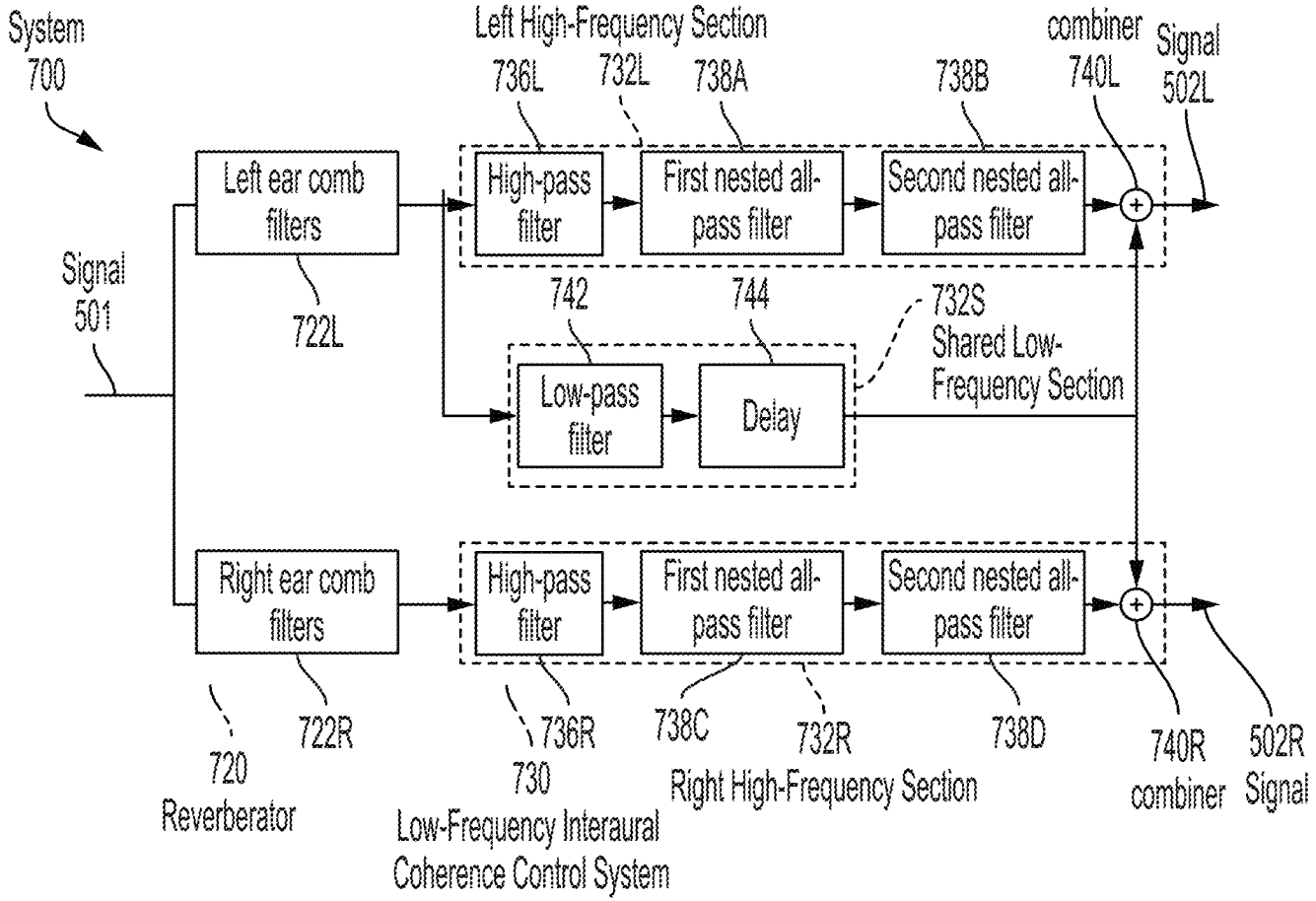
FIG. 7A illustrates a block diagram of an exemplary system including a reverberator and a low-frequency interaural coherence control system, according to some embodiments.
Figure 7B:
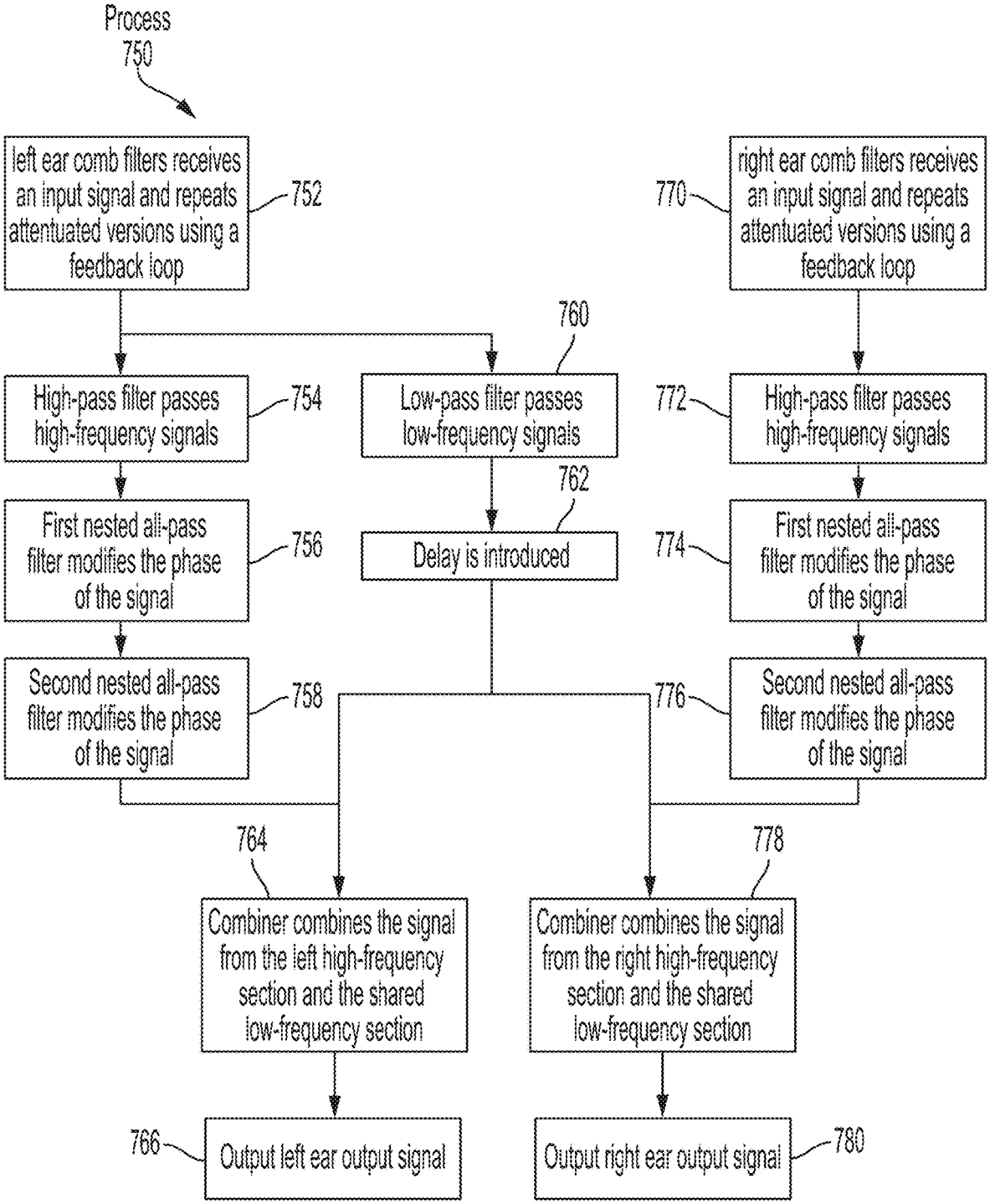
FIG. 7B illustrates a flow of an exemplary method for operating the system of FIG. 7A.

FIG. 7A illustrates a block diagram of an exemplary system including a reverberator and a low-frequency interaural coherence control system, according to some embodiments. FIG. 7B illustrates a flow of an exemplary method for operating the system of FIG. 7A.

The system 700 can include a reverberator 720 and a low-frequency interaural coherence control system 730. The reverberator 720 may be connected in series with the low-frequency interaural coherence control system 730 such that the outputs from the reverberator 720 are received as inputs to the low-frequency interaural coherence control system 730.

The reverberator 720 can include two sets of comb filters: left ear comb filters 722L and right ear comb filters 722R. Both sets of comb filters 722L/722R can receive the input signal 501.

The low-frequency interaural coherence control system 730 can include a left high-frequency section 732L, a shared low-frequency section 732S, and a right high-frequency section 732R. The terms "left high-frequency," "shared low-frequency section," and "right high-frequency section" are used to describe different sections/paths.

The left ear comb filters 722L can output signals to the high-frequency section 732L and the shared low-frequency section 732S. The right ear comb filters 722R can output a signal to the right high-frequency section 732R.

The left high-frequency section 732L can include a plurality of filters: a high-pass filter 736L, a first nested all-pass filter 738A, a second nested all-pass filter 738B, and a combiner 740L. The output signal from the left ear comb filters 722L can be input to the high-pass filter 736L. The output signal from the high-pass filter 736L can be input to the first nested all-pass filter 738A. The output signal from the first nested all-pass filter 738A can be input to the second nested all-pass filter 738B.

Similarly, the right high-frequency section 732R can include a plurality of filters: a high-pass filter 738R, a first nested all-pass filter 738C, a second nested all-pass filter 738D, and a combiner 740R. The output signal from the right ear comb filters 722R can be input to the high-pass filter 736R. The output signal from the high-pass filter 736R can be input to the first nested all-pass filter 738C. The output signal from the first nested all-pass filter 738C can be input to the second nested all-pass filter 738D.

The high-pass filters 736 can be configured to pass portions of the signal(s) having a frequency higher than a high-frequency threshold. The all-pass filters can be configured to pass all signals. The combiner can be configured to combine its input signals to form one or more output signals.

The shared low-frequency section 732S can include a low-pass filter 742 and a delay 744. The shared low-frequency section 732S may be referred to as a low-frequency management system. In some embodiments, the components of the left high-frequency section 732L, the shared low-frequency section 732S, and/or the right high-frequency section 732R may be in any order; examples of the disclosure are not limited to the configuration illustrated in FIG. 7A.

The left ear comb filters 722L can receive an input signal (signal 501) and can repeat attenuated versions of its input signal using a feedback loop (step 752 of process 750). The left ear comb filters 722L can output signals to the left high-frequency section 732L and the shared low-frequency section 732S. Specifically, the left ear comb filters 722L can output a signal to the high-pass filter 736L of the left high-frequency section 732L and the low-pass filter 742 of the shared low-frequency section 732S. The right ear comb filters 722R can receive an input signal (signal 501) and can repeat attenuated versions of its input signal using a feedback loop (step 770). The right ear comb filters 722R can output a signal to the right high-frequency section 732R. Specifically, the right ear comb filters 722R can output a signal to the high-pass filter 736R of the right high-frequency section 732R.

In the left high-frequency section 732L, the high-pass filter 736L can receive the signal output from the left ear comb filters 722L and can pass those signals having a frequency higher than a high-frequency threshold (i.e., high-frequency signals) as outputs (step 754). The outputs from the high-pass filter 736L can be input to the first nested all-pass filter 738A. The first nested all-pass filter 738A can receive this signal from the high-pass filter 736L and can modify its phase without changing its magnitude response (step 756). The first nested all-pass filter 738A can output a signal to be received as input by the second nested all-pass filter 738B. The second nested all-pass filter 738B can receive this signal from the first nested all-pass filter 738A and can modify its phase without changing its magnitude response (step 758). The second nested all-pass filter 738B can output a signal to the combiner 740L.

In the right high-frequency section 732R, the high-pass filter 736R can receive the signal output from the right ear comb filters 722R and can pass those signals having a frequency higher than a high-frequency threshold as outputs (step 772). The outputs from the high-pass filter 736R can be input to the first nested all-pass filter 738C. The first nested all-pass filter 738C can receive this signal from the high-pass filter 736R and can modify its phase without changing its magnitude response (step 774). The first nested all-pass filter 738C can output a signal to be received as input by the second nested all-pass filter 738D. The second all-pass filter 738D can receive this signal from the first nested all-pass filter 738C and can modify its phase without changing its magnitude response (step 776). The second nested all-pass filter 738D can output a signal to the combiner 740R.

In the shared low-frequency section 732S, the low-pass filter 742 can receive the signal output from the left ear comb filters 722L and can pass portions of the signal(s) having a frequency lower than a low-frequency threshold (i.e., low-frequency signals) as outputs (step 760). In some embodiments, those signals that are not passed by the high-pass filter 736L (of the left high-frequency section 732L) may be passed by the low-pass filter 742. In some embodiments, those signals that are not passed by the low-pass filter 742 (of the shared low-frequency section 732S) may be passed by the high-pass filter 736L (of the left high-frequency section 732L). The outputs from the low-pass filter 742 can be input to the delay 744. The delay 744 can introduce a delay into its input signal (from the low-pass filter 742) (step 762). The output signals from the delay 744 can be inputs to the combiners 740L (of the left high-frequency section 732L) and 740R (of the right high-frequency section 732R).

The combiner 740L of the left high-frequency section 732L can receive a signal from the second nested all-pass filter 738B (of the left high-frequency section 732L) and a signal from the delay 744 (of the shared low-frequency section 732S). The combiner 740L can combine (e.g., sum the input signals) (step 764) and can output the resultant signal as signal 502L. The output from the combiner 740L can be the left ear output signal (step 766).

The combiner 740R of the right high-frequency section 732R can receive a signal from the second nested all-pass filter 738D (of the right high-frequency section 732R) and a signal from the delay 744 (of the shared low-frequency section 732S). The combiner 740R can combine (e.g., sum the input signals) (step 778) and can output the resultant signal as signal 502R. The output from the combiner 740R can be the right ear output signal (step 780).

As discussed previously, the shared low-frequency section 732S is a low-frequency management system. The delay in the signals introduced by the shared low-frequency section 732S to both the left high-frequency section 732L and the right high-frequency section 732R can help control the interaural coherence. Since the delay is introduced on signals that have a frequency lower than a low-frequency threshold (filtered by the low-pass filter 742), the system 700 can achieve high coherence at low frequencies. In some embodiments, each section 732 controls a certain frequency range of the signals that propagate through the given section. For example, the high-pass filter 736L controls signals of the left high-frequency section 732L; the high-pass filter 736R controls of the right high-frequency section 732R; and the low-pass filter 742 control signals of the shared low-frequency section 732S.

In some embodiments, the delay 744 can align its output signal with the output signal from the second nested all-pass filter 738B of the left high-frequency section 732L. Additionally or alternatively, the delay 744 can align its output signal with the output signal of the second nested all-pass filter 738D of the right high-frequency section 732R.

Figure 8:
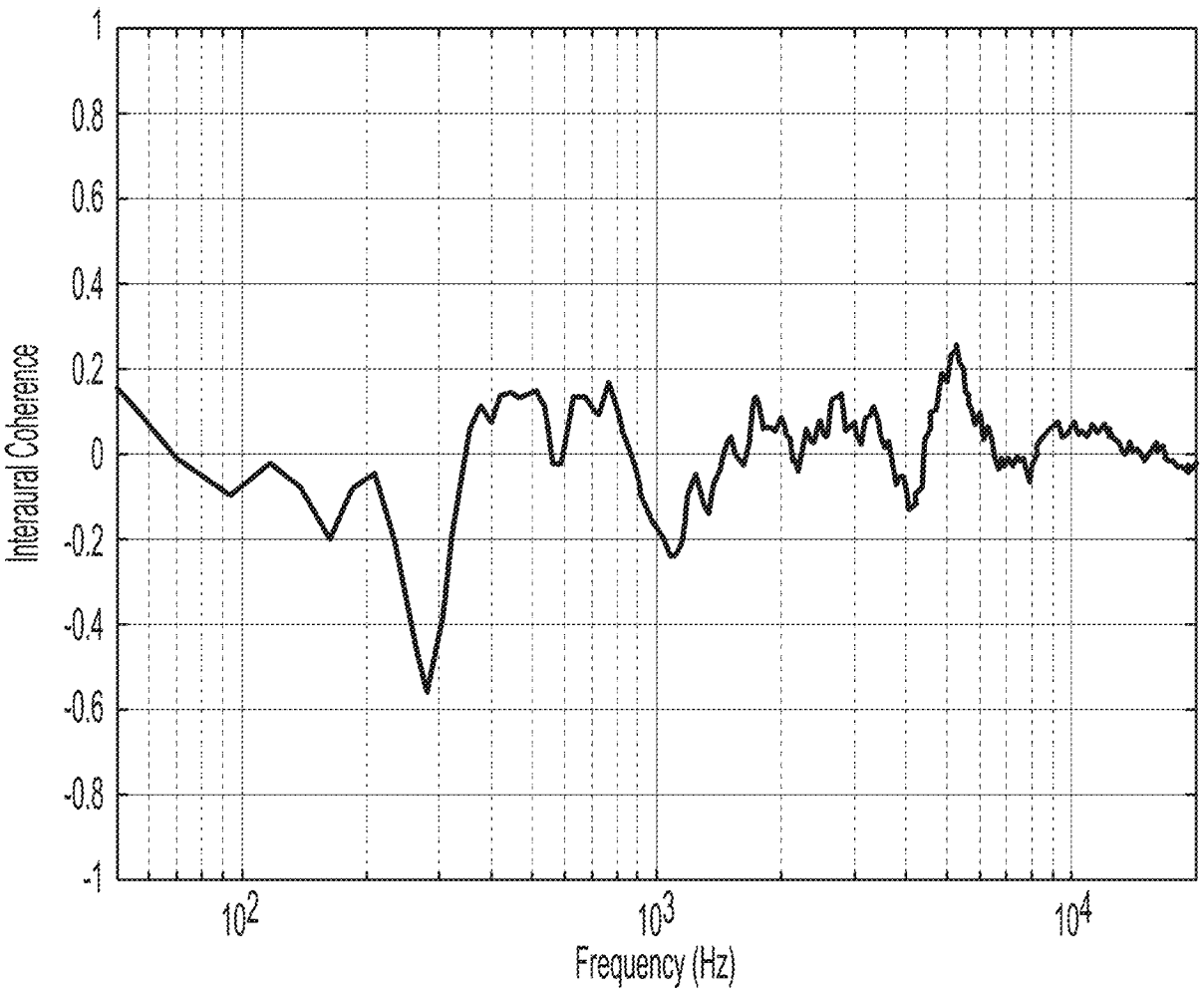
FIG. 8 illustrates a plot of the interaural coherence output from the reverberator of the system of FIG. 7A, according to some embodiments.

FIG. 8 illustrates a plot of the interaural coherence output from the reverberator 720 of the system of FIG. 7A, according to some embodiments. As shown in the figure, the interaural coherence may be low across all (low, mid, and high) frequencies.

Figure 9:
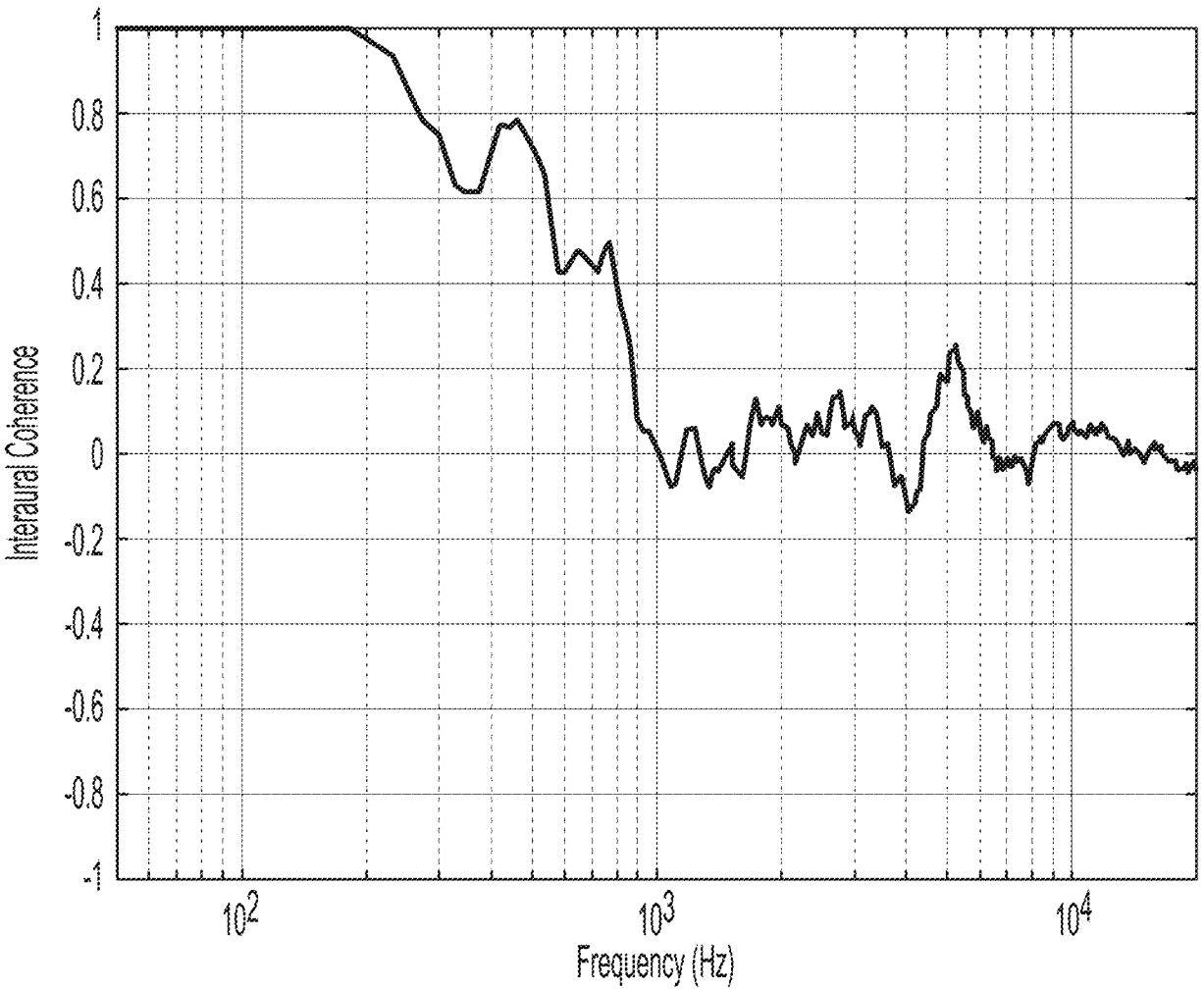
FIG. 9 illustrates a plot of the interaural coherence output from the low-frequency interaural coherence control system of FIG. 7A, according to some embodiments.

FIG. 9 illustrates a plot of the interaural coherence output from the low-frequency interaural coherence control system 730 of FIG. 7A, according to some embodiments. As shown in the figure, the interaural coherence may be high at low frequencies (e.g., less than 1 kHz) and low at mid and high frequencies (e.g., greater than 1 kHz). In some embodiments, the shared low-frequency section 732S can control the interaural coherence for low frequencies. In some embodiments, the left high-frequency section 732L and the right high-frequency section 732R can control the interaural coherence for mid and/or high frequencies. In this manner, the low-frequency coherence control system can include a shared section and multiple dedicated sections. The shared section may be for controlling low-frequency signals, and the dedicated sections may be for controlling high-frequency signals.

Exemplary Filters

Figure 10:
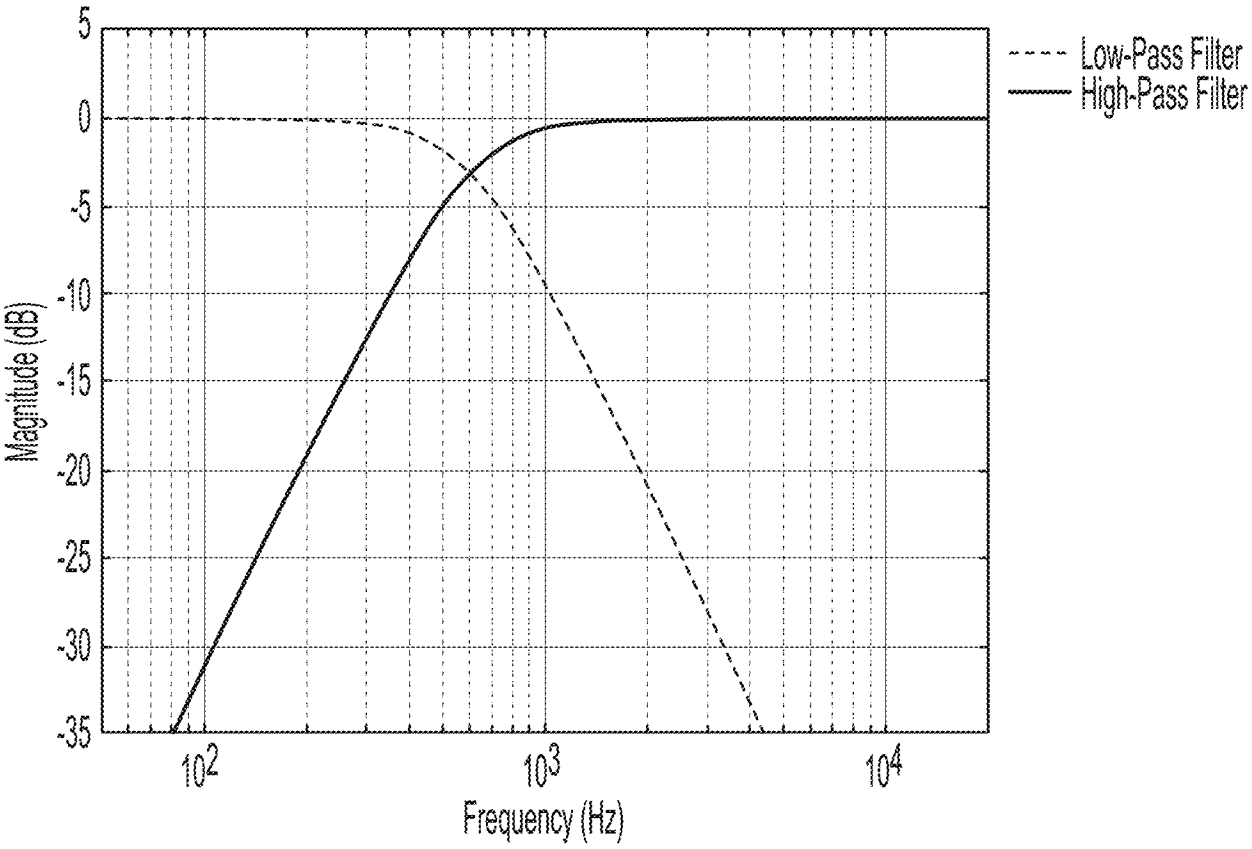
FIG. 10 illustrates example frequency responses of a high-pass filter and a low-pass filter realized using second order Butterworth filters, according to some embodiments.

FIG. 10 illustrates example frequency responses of a high-pass filter and a low-pass filter realized using second order Butterworth filters, according to some embodiments. As shown in the figure, the high-pass filter (e.g., high-pass filter 736L, high-pass filter 736R, or both) can pass signals have a frequency higher than a high-frequency threshold. For example, the high-pass filter can pass signals having a frequency higher than 1 kHz. In some examples, the response of the high-pass filter may have a slope where in a certain frequency range (e.g., about 100 Hz to 1 kHz), the high-pass filter may partially pass the signals. In some embodiments, the high-pass filter may be a second-order Butterworth filter.

Also shown in the figure, the low-pass filter (e.g., low-pass filter 742) can pass signals having a frequency less than a low-frequency threshold. For example, the low-pass filter can pass signals having a frequency less than 200 Hz. In some examples, the response of the high-pass filter may have a slope where in a certain frequency range (e.g., about 200 Hz to 4 kHz), the low-pass filter may partially pass the signals. In some embodiments, the low-pass filter may be a second-order Butterworth filter.

In some embodiments, the interaural coherence can transition from high to low at a certain frequency range. The frequency range may be controlled by adjusting the crossover point and slope of two or more filters: the high-pass filter 736L (of the left high-frequency section 732L), the high-pass filter 736R (of the right high-frequency section 732R), and the low-pass filter 742 (of the shared low-frequency section 732S).

Figure 11:
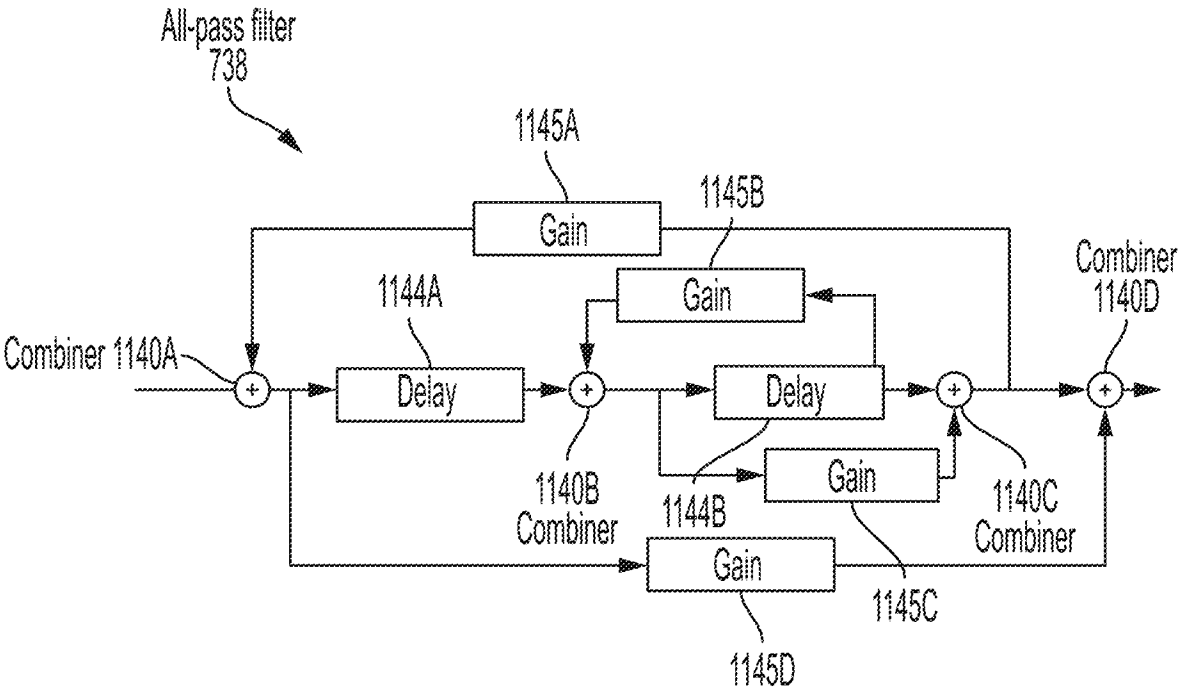
FIG. 11 illustrates an example nested all-pass filter, according to some embodiments.

FIG. 11 illustrates an example nested all-pass filter, according to some embodiments. The all-pass filter 738 illustrated in the figure may be one or more of the all-pass filters 738A, 738B, 738C, and 738D illustrated in FIG. 7A, for example. The all-pass filter 738 can include a plurality of components: gain 1145A, gain 1145B, gain 1145C, gain 1145D, delay 1144A, delay 1144B, combiner 1140A, combiner 1140B, combiner 1140C, and combiner 1140D.

As discussed previously, the all-pass filter 738 can be configured to pass all frequencies in the input signal. In some examples, the all-pass filter 738 can pass the signal without changing its magnitude, but while also changing the phase relationship among the frequencies. The input signal to the all-pass filter 738 can be presented, along with the output from gain 1145A, as input to the combiner 1140A. The output from the combiner 1140A can be presented as input to the delay 1144A and the gain 1145D.

The delay 1144A can introduce a certain delay into the signal and its output can be presented, along with the output from the gain 1145B, as input to the combiner 1140B. The output from the combiner 1140B can be presented as input to the delay 1144B and the gain 1145C. The delay 1144B can introduce a certain amount of delay and can output its signal to the combiner 1140C. The combiner 1140C can also receive a signal from the gain 1145C.

The gain 1145A, the gain 1145B, the gain 1145C, and the gain 1145D can introduce a certain amount of gain into the respective input signal. The combiner 1140D can receive the outputs from the combiner 1140C and the gain 1145D and combine (e.g., sum) the signals.

In some embodiments, the reverberator 720 of FIG. 7A may be realized using a network of feedback and feedforward processing blocks. The network may include, for example, standalone comb filters or a more complex feedback delay network (FDN), as well as all-pass filters. In some embodiments, regardless of reverberator topology, a reverberation decay time may be controlled by considering the reverberator as a collection of interconnected delay units and inserting an absorption coefficient with each delay unit in the network.

If one or more additional processing blocks including a delay unit are associated in cascade with a reverberator, as is the case in the system of FIG. 7A, extra processing by the one or more additional processing blocks including the delay unit may introduce some extra decay, or time smearing, and may limit the ability of the overall system to realize short reverberation times.

Figure 12A:
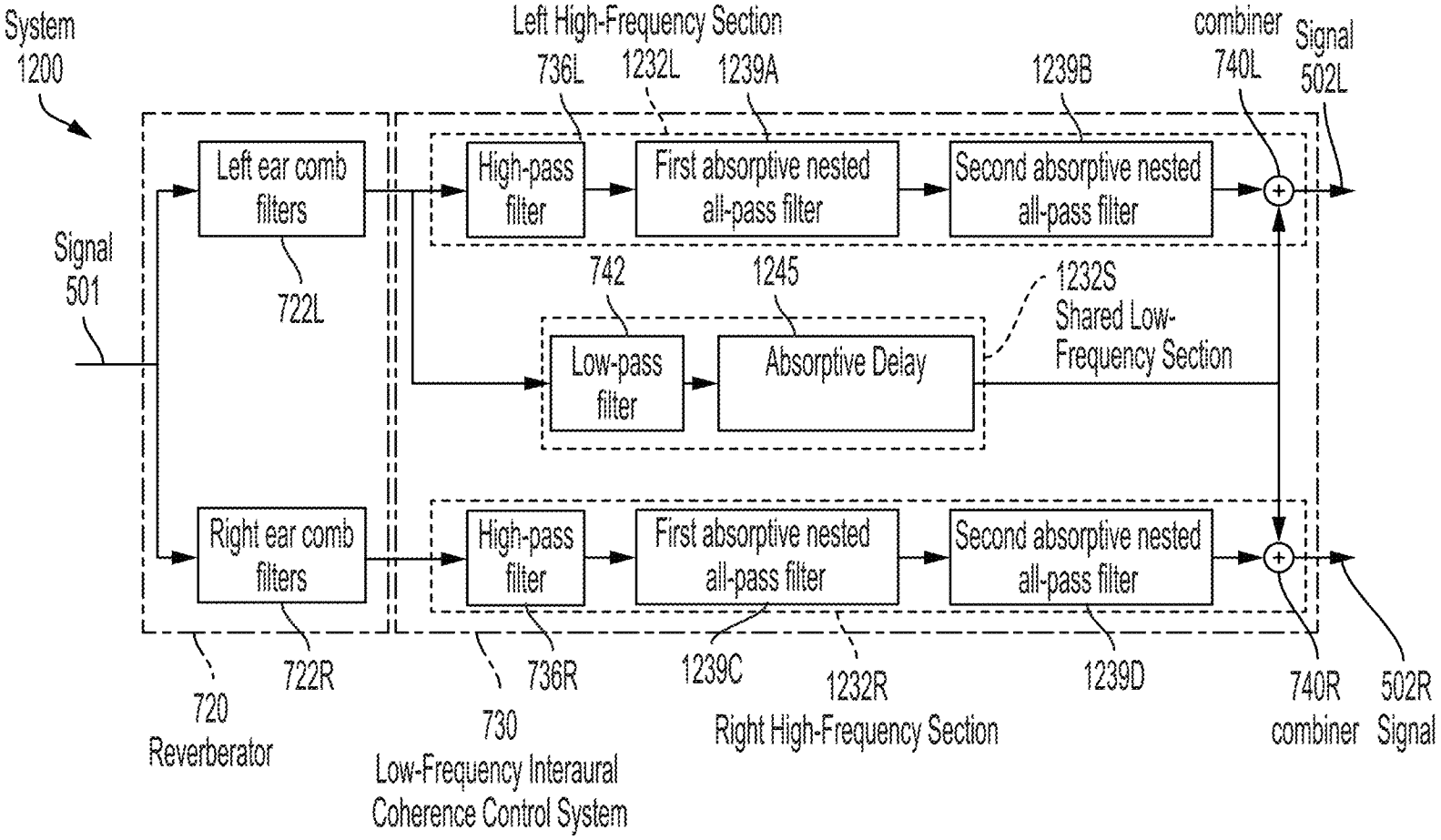
FIG. 12A illustrates a block diagram of an exemplary system including a reverberator and a low-frequency interaural coherence control system, according to some embodiments.

FIG. 12A illustrates a block diagram of an exemplary system including a reverberator and a low-frequency interaural coherence control system, according to some embodiments.

The low-frequency interaural coherence control system 1200 may be similar to the low-frequency interaural coherence control system 700 of FIG. 7A, with some differences. For example, the left high-frequency section 732L of FIG. 7A includes a first nested all-pass filter 738A and a second nested all-pass filter 738B, whereas the left high-frequency section 1232L of FIG. 12A includes a first absorptive nested all-pass filter 1239A and a second absorptive nested all-pass filter 1239B. Similarly, the right high-frequency section 732R of FIG. 7A includes a first nested all-pass filter 739C and a second nested all-pass filter 739D, whereas the right high-frequency section 1232R of FIG. 12A includes a first absorptive nested all-pass filter 1239C and a second absorptive nested all-pass filter 1239D. The shared low-frequency section 732S of FIG. 7A includes a delay 744, whereas the shared low-frequency section 1232S of FIG. 12A includes an absorptive delay 1245.

The respective absorptive delay units of the low-frequency interaural coherence control system 1200 of FIG. 12A may be configured with one or more absorption coefficients to enable a reverberation time of the overall system to be exactly the same as a targeted reverberation time of the original reverberator.

An absorption gain, or attenuation, $gain_d$, in each absorptive delay unit (e.g., the first absorptive nested all-pass filter 1239A of the left high-frequency section 1232L, the second absorptive nested all-pass filter 1239B of the left high-frequency section 1232L, the first absorptive nested all-pass filter 1239C of the right high-frequency section 1232R, the second absorptive nested all-pass filter 1239D of the right high-frequency section 1232R, and/or the absorptive delay 1245 of the shared low-frequency section 1232S) may be expressed as a function of a corresponding delay, d. Equation (1) includes a formula of the absorption gain, $gain_d$, as a function of the corresponding delay, d, according to some embodiments.

$$gain_d = 10^{-\frac{\frac{d}{T60}*60}{20}} \Rightarrow gain_d = 10^{-\frac{del}{T60}} \tag{1}$$

In Equation (1), T60 may be a reverberation time expressed in the same unit as the delay.

Figure 12B:
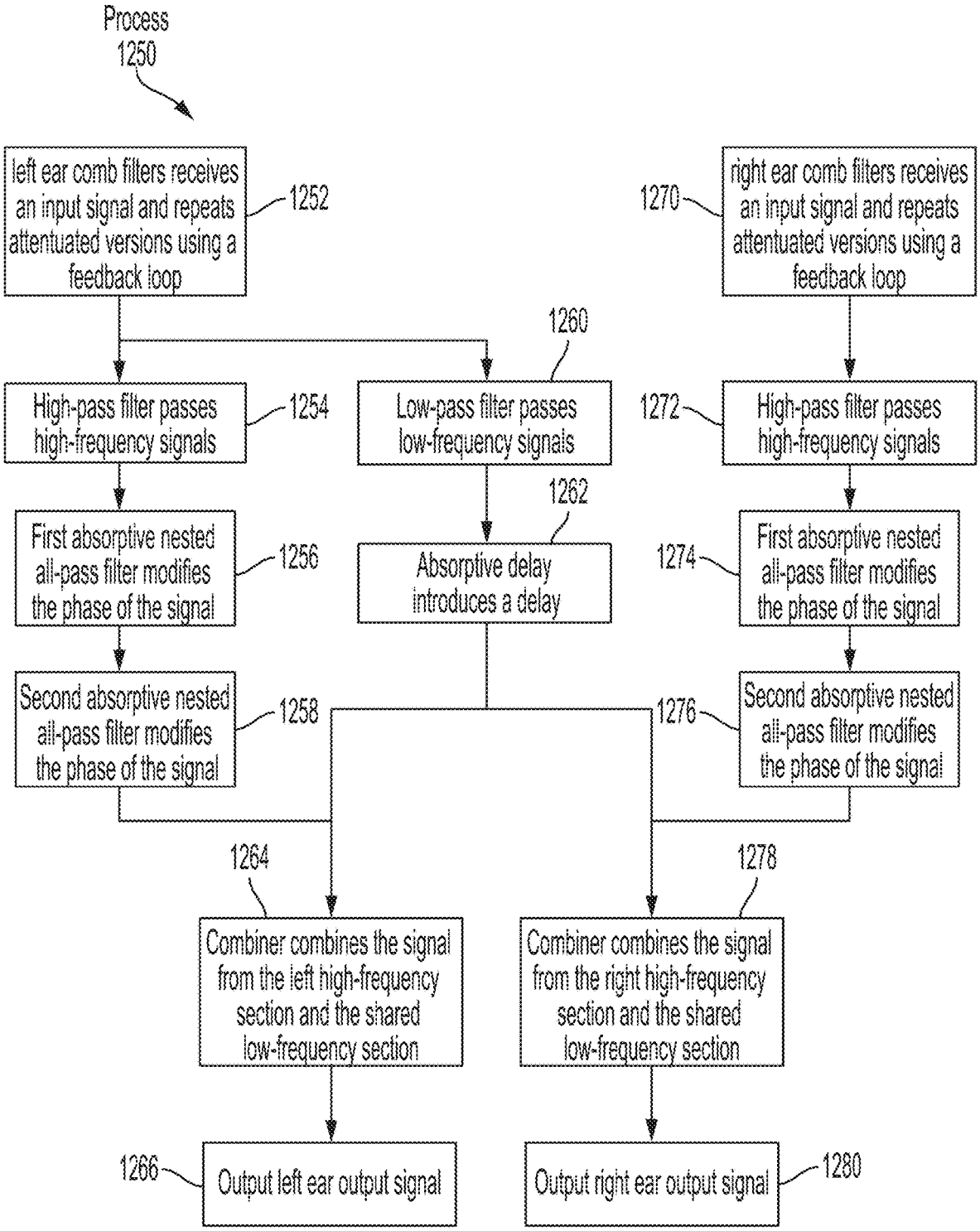
FIG. 12B illustrates a flow an exemplary method for operating the system of FIG. 12A, according to some embodiments.

FIG. 12B illustrates a flow an exemplary method for operating the system of FIG. 12A. Process 1250 includes steps 1252, 1254, 1260, 1264, 1266, 1270, 1272, 1278, and 1280 that are correspondingly similar to steps 752, 754, 760, 764, 766, 770, 772, 778, and 780, respectively, described in the context of process 750 of FIG. 7B. The process 1250 also includes steps 1256, 1258, 1262, 1274, and 1276. Steps 1256, 1258, 1262, 1274, and 1276 can be similar to steps 756, 758, 762, 774, and 776 (of FIG. 7B), respectively, but may use absorptive delay units to enable a reverberation time.

Embodiments of Low-Frequency Coherence Control Systems

FIGS. 13A, 14A, 15A, and 16A illustrate example low-frequency interchannel coherence control systems 1330, 1430, 1530, and 1630, respectively, according to various embodiments. Each of the low-frequency interchannel coherence control systems 1330, 1430, 1530, and 1630 can include a left high-frequency section, a shared low-frequency section, and a right high-frequency section.

In some embodiments, the low-frequency interchannel coherence control systems 1330, 1430, 1530, and 1630 may receive a plurality of input signals: signal 1301A and signal 1301B. In some embodiments, the signals 1301A and 1301B may have substantially identical spectral content but low mutual interchannel coherence. Two signals may have substantially identical spectral content but low mutual interchannel coherence when, for example, produced by a two-channel reverberator. Exemplary two-channel reverberators are reverberator 720 of FIGS. 7A and 12A. Although the reverberator 720 is a two-channel reverberator, examples of the disclosure can include reverberators having any number of channels.

In some embodiments, the low-frequency interchannel coherence control systems 1330, 1430, 1530, and 1630 may output a plurality of output signals: signal 1302L and 1302R.

In some embodiments, the low-frequency interchannel coherence control systems 1330, 1430, 1530, and 1630 may include high-pass filters 736L, high-pass filters 736R, low-pass filters 742, and delay 744 that may be correspondingly similar to those of FIGS. 7A and 12A. Additionally or alternatively, these filters may be realized using the second order Butterworth filters described above in the context of FIG. 10.

In some embodiments, the low-frequency interchannel coherence control systems 1330, 1430, 1530, and 1630 may include combiners 740L and 740R that may be correspondingly similar to those of FIGS. 7A and 12A.

In some embodiments, the low-frequency interchannel coherence control systems 1330 and 1430 may also include high-frequency processing units 1337L and 1337R. The high-frequency processing units 1337 may be all-pass filters (include any type of all-pass filter such as a nested all-pass filter and/or a cascaded all-pass filter) or absorptive all-pass filters.

Figure 13A:
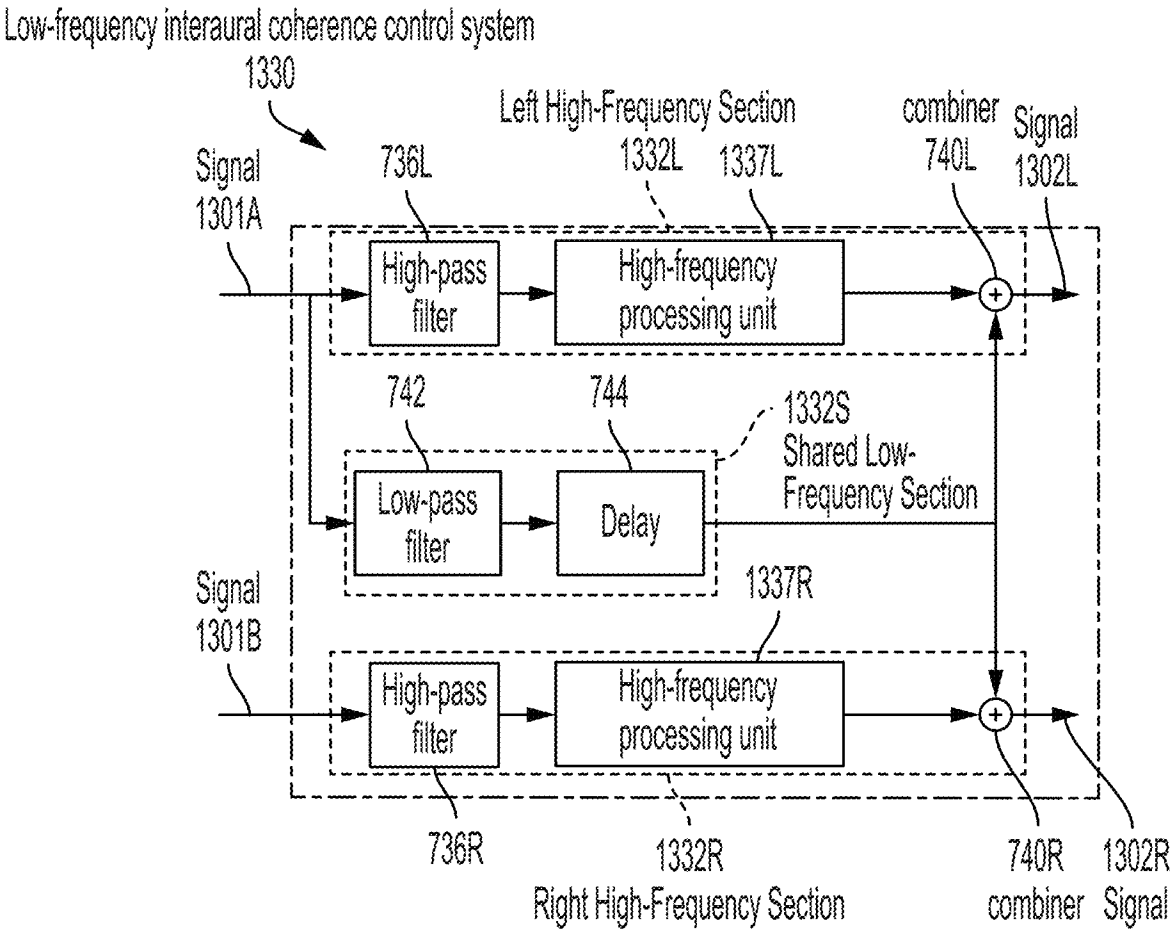
FIG. 13A illustrates a block diagram of an example low-frequency interchannel coherence control system including high-frequency processing units located between the filters and the output signals, according to some embodiments.
Figure 13B:
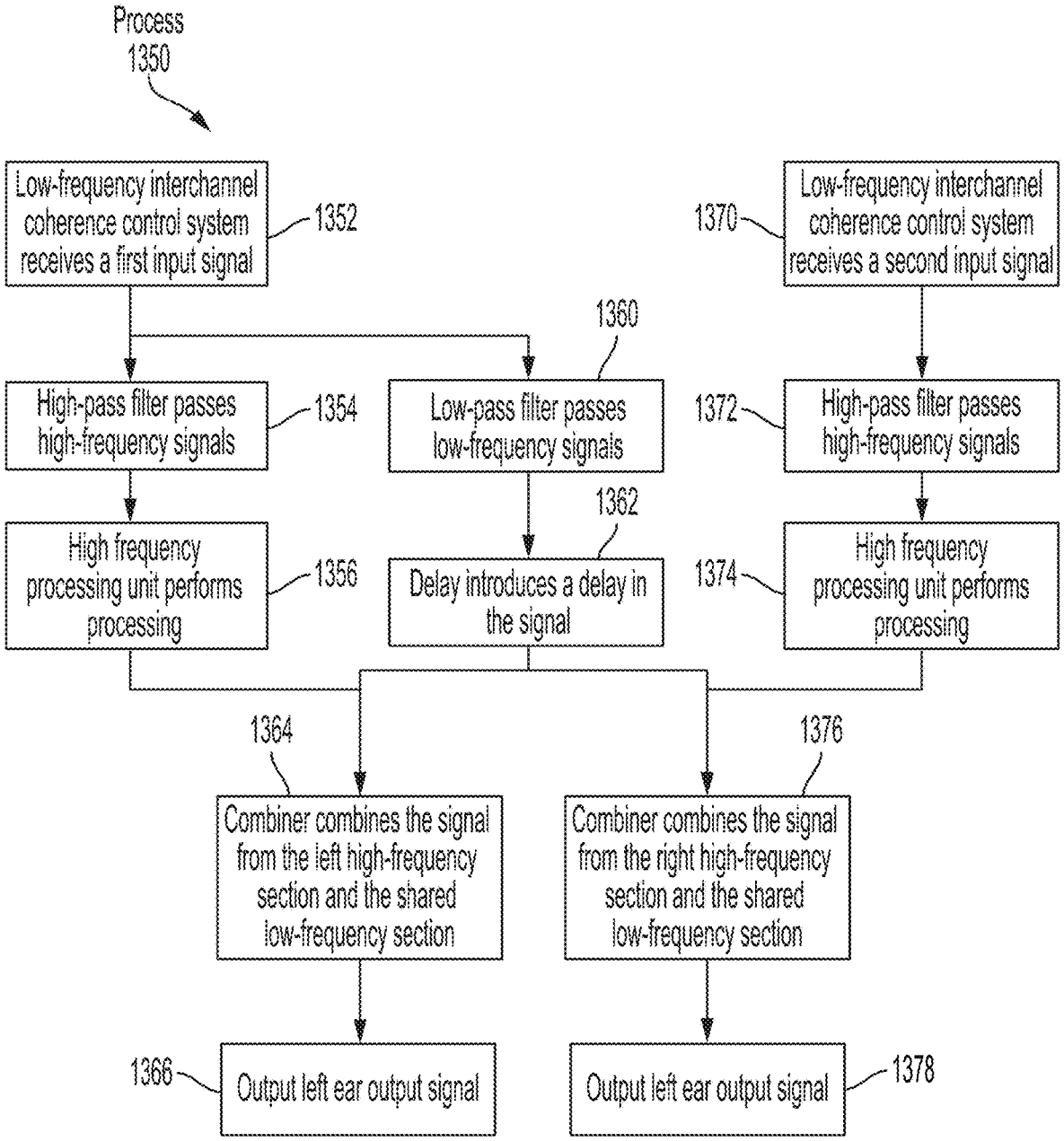
FIG. 13B illustrates a flow of an exemplary method for operating the system of FIG. 13A.

FIG. 13A illustrates a block diagram of an example low-frequency interchannel coherence control system including high-frequency processing units located between the filters and the output signals, according to some embodiments. FIG. 13B illustrates a flow of an exemplary method for operating the system of FIG. 13A.

The low-frequency interchannel coherence control system 1330 can include a left high-frequency section 1332L, a shared low-frequency section 1332S, and a right high-frequency section 1332R. The left high-frequency section 1332L can include a high-pass filter 736L, a high-frequency processing unit 1337L, and a combiner 740L. Similarly, the right high-frequency section 1332R can include a high-pass filter 736R, a high-frequency processing unit 1337R, and a combiner 740R. The shared low-frequency section 1332S can include a low-pass filter 742 and a delay 744.

In the left high-frequency section 1332L, the high-pass filter 736L receives a first input signal 1301A (step 1352 of process 1350). The high-pass filter 736L can be configured to pass signals having a frequency higher than a high-frequency threshold to the high-frequency processing unit 1337L (step 1354). The high-frequency processing unit 1337L can be configured to perform processing on the signal from the high-pass filter 736L (step 1356). As discussed above, the high-frequency processing unit 1337L can include one or more types of filters, and the processing on the signal from the high-pass filter 736L can perform a corresponding function of the type of filter. The high-frequency processing unit 1337L then outputs a signal to the combiner 740L.

In the right high-frequency section 1332R, the high-pass filter 736R receives a second input signal 1301 (step 1370). The high-pass filter 736R can be configured to pass signals having a frequency higher than a high-frequency threshold to the high-frequency processing unit 1337R (step 1372). The high-frequency processing unit 1337R can be configured to perform processing on the signal from the high-pass filter 736R (step 1374). As discussed above, the high-frequency processing unit 1337R can include one or more types of filters, and the processing on the signal from the high-pass filter 736R can perform a corresponding function of the type of filter. The high-frequency processing unit 1337R then outputs a signal to the combiner 740R.

In the shared low-frequency section 1332S, the low-pass filter 742 receives the first input signal 1301A. The low-pass filter 742 can be configured to pass signals having a frequency less than a low-frequency threshold (step 1360). In some embodiments, the low-frequency interaural coherence control system 1330 may include a delay 744. The delay 744 can introduce a delay into its input signal (from the low-pass filter 742) (step 1362). The output signals from the delay 744 can be inputs to the combiners 740L (of the left high-frequency section 1332L) and 740R (of the right high-frequency section 1332R).

The combiner 740L receives signals from the high-frequency processing unit 1337L (of the left high-frequency section 1332L) and from the shared low-frequency section 1332S. The combiner 740L combines (e.g., sums) the two received signals (step 1364) and outputs a first output signal 1302L (step 1366).

The combiner 740R receives signals from the high-frequency processing unit 1337R (of the right high-frequency section 1332R) and from the delay 744 (of the shared low-frequency section 1332S). The combiner 740R combines (e.g., sums) the two received signals (step 1376) and outputs a second output signal 1302R (step 1378).

In some embodiments, the low-frequency interaural coherence control system 1330 may optionally include the delay 744 in its shared low-frequency section 1332S. In such embodiments, the signal from the low-pass filter 742 may be directly input to the combiners 740L and 740R.

Figure 14A:
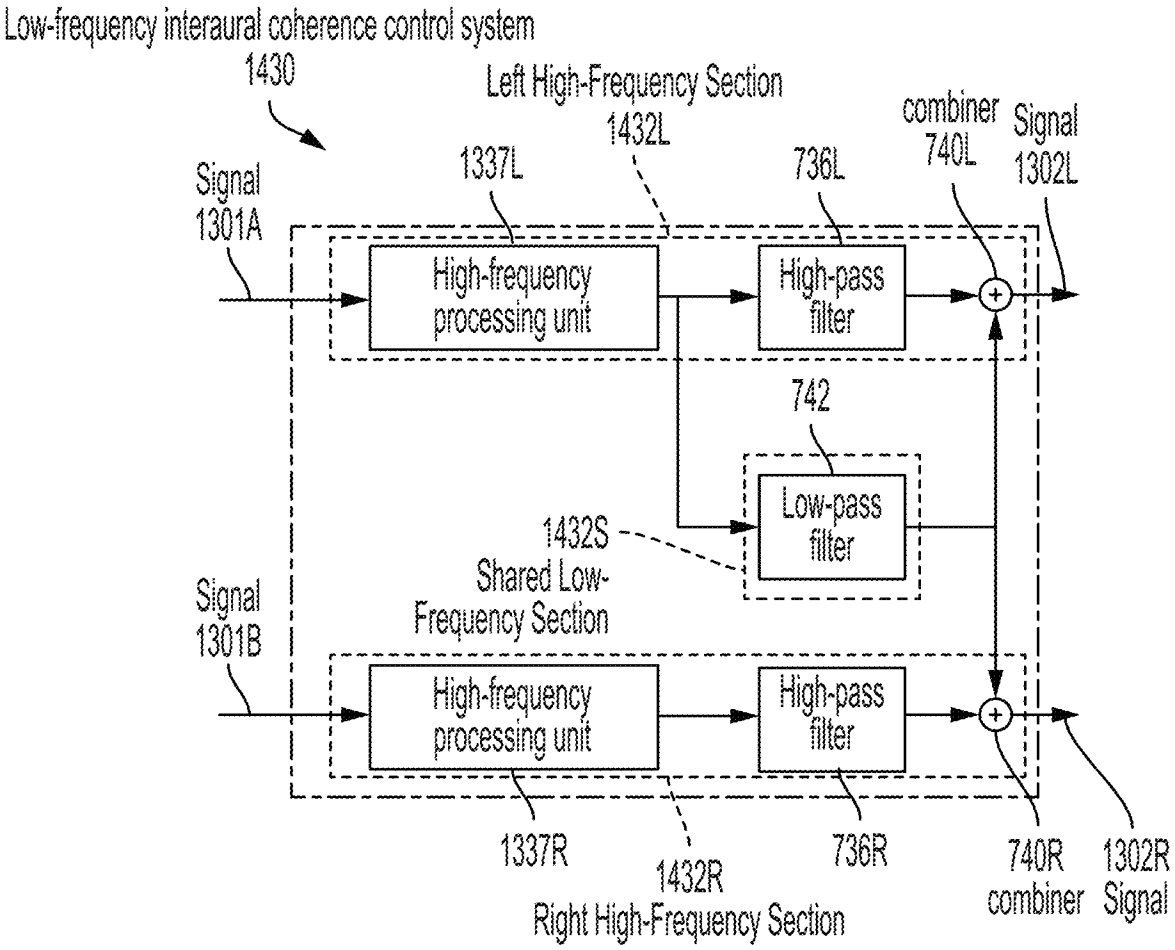
FIG. 14A illustrates a block diagram of an example low-frequency interchannel coherence control system including high-frequency processing units located between the inputs signals and the filters, according to some embodiments.
Figure 14B:
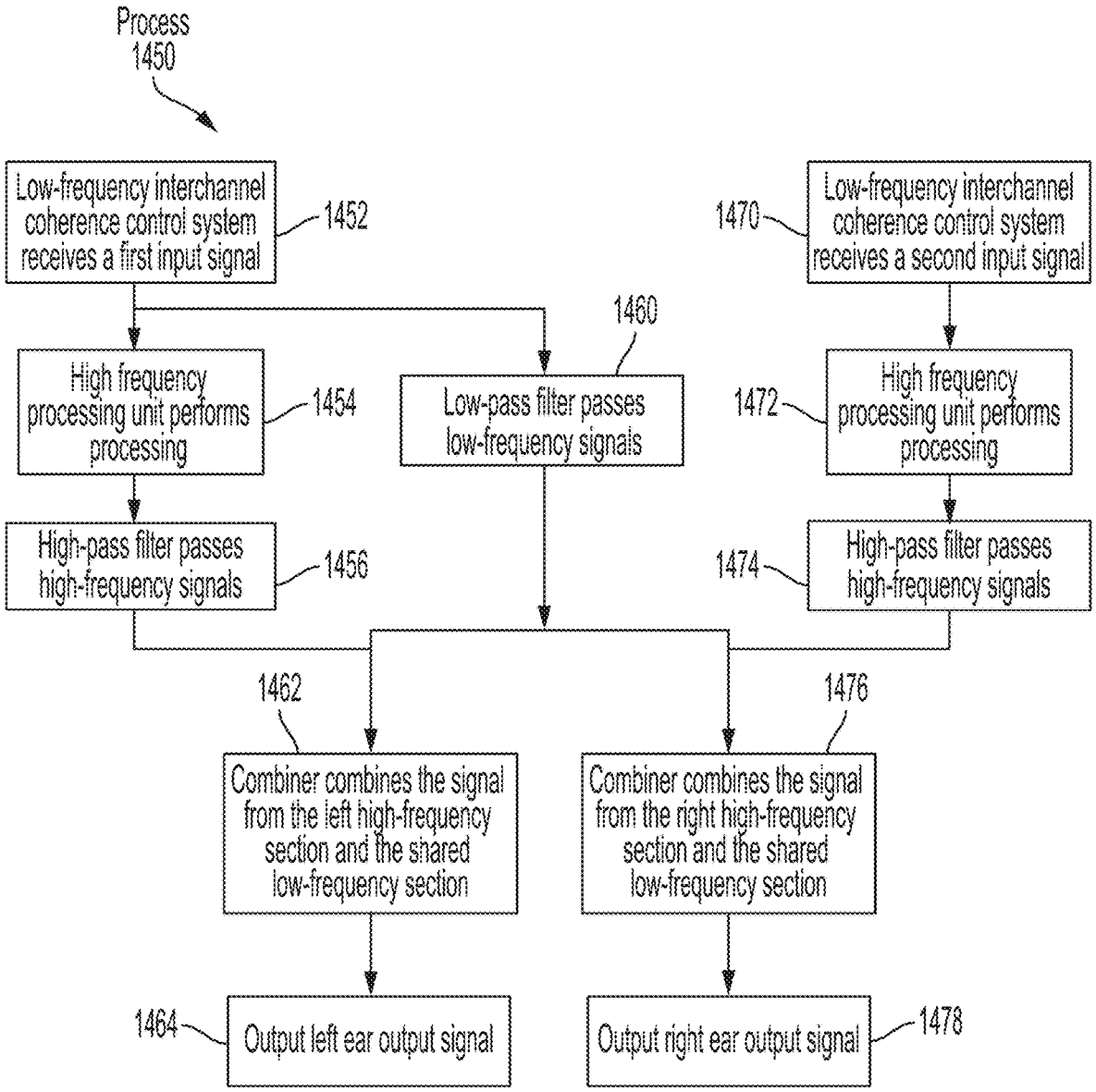
FIG. 14B illustrates a flow of an exemplary method for operating the system of FIG. 14A.

FIG. 14A illustrates a block diagram of an example low-frequency interchannel coherence control system including high-frequency processing units located between the inputs signals and the filters, according to some embodiments. FIG. 14B illustrates a flow of an exemplary method for operating the system of FIG. 14A.

The low-frequency interchannel coherence control system 1430 can include a left high-frequency section 1432L, a shared low-frequency section 1432S, and a right high-frequency section 1432R. The left high-frequency section 1432L can include a high-frequency processing unit 1337L, a high-pass filter 736L, and a combiner 740L. Similarly, the right high-frequency section 1432R can include a high-frequency processing unit 1437R, a high-pass filter 736R, and a combiner 740R. The shared low-frequency section 1432S can include a low-pass filter 742.

In the left high-frequency section 1432L, the high-frequency processing unit 1337L receives a first input signal 1301A (step 1452 of process 1450). The high-frequency processing unit 1337L can be configured to perform processing on the signal 1301A (step 1454). As discussed above, the high-frequency processing unit 1337L can include one or more types of filters, and can perform processing on the signal 1301A corresponding to the function of the given filter. The high-frequency processing unit 1337L then outputs a signal to the high-pass filter 736L. The high-pass filter 736L can be configured to pass signals having a frequency higher than a high-frequency threshold to the combiner 740L (step 1456).

In the right high-frequency section 1432R, the high-frequency processing unit 1337R receives a first input signal 1301B (step 1470). The high-frequency processing unit 1337R can be configured to perform processing on the signal 1301B (step 1472). As discussed above, the high-frequency processing unit 1337R can include one or more types of filters, and can perform processing on the signal 1301B corresponding to the function of the given filter. The high-frequency processing unit 1337R then outputs a signal to the high-pass filter 736R. The high-pass filter 736R can be configured to pass signals having a frequency higher than a high-frequency threshold to the combiner 740R (step 1474).

In the shared low-frequency section 1432S, the low-pass filter 742 receives the first input signal 1301A. The low-pass filter 742 can be configured to pass signals having a frequency less than a low-frequency threshold to the combiners 740L and 740R (step 1460).

The combiner 740L receives signals from the high-pass filter 736L (of the left high-frequency section 1432L) and from the low-pass filter 742 (of the shared low-frequency section 1432S). The combiner 740L combines (e.g., sums) the two received signals (step 1462) and outputs a first output signal 1302L (step 1464).

The combiner 740R receives signals from the high-pass filter 736R (of the right high-frequency section 1432R) and from the low-pass filter 742 (of the shared low-frequency section 1432S). The combiner 740R combines (e.g., sums) the two received signals (step 1476) and outputs a second output signal 1302R (step 1478).

Figure 15A:
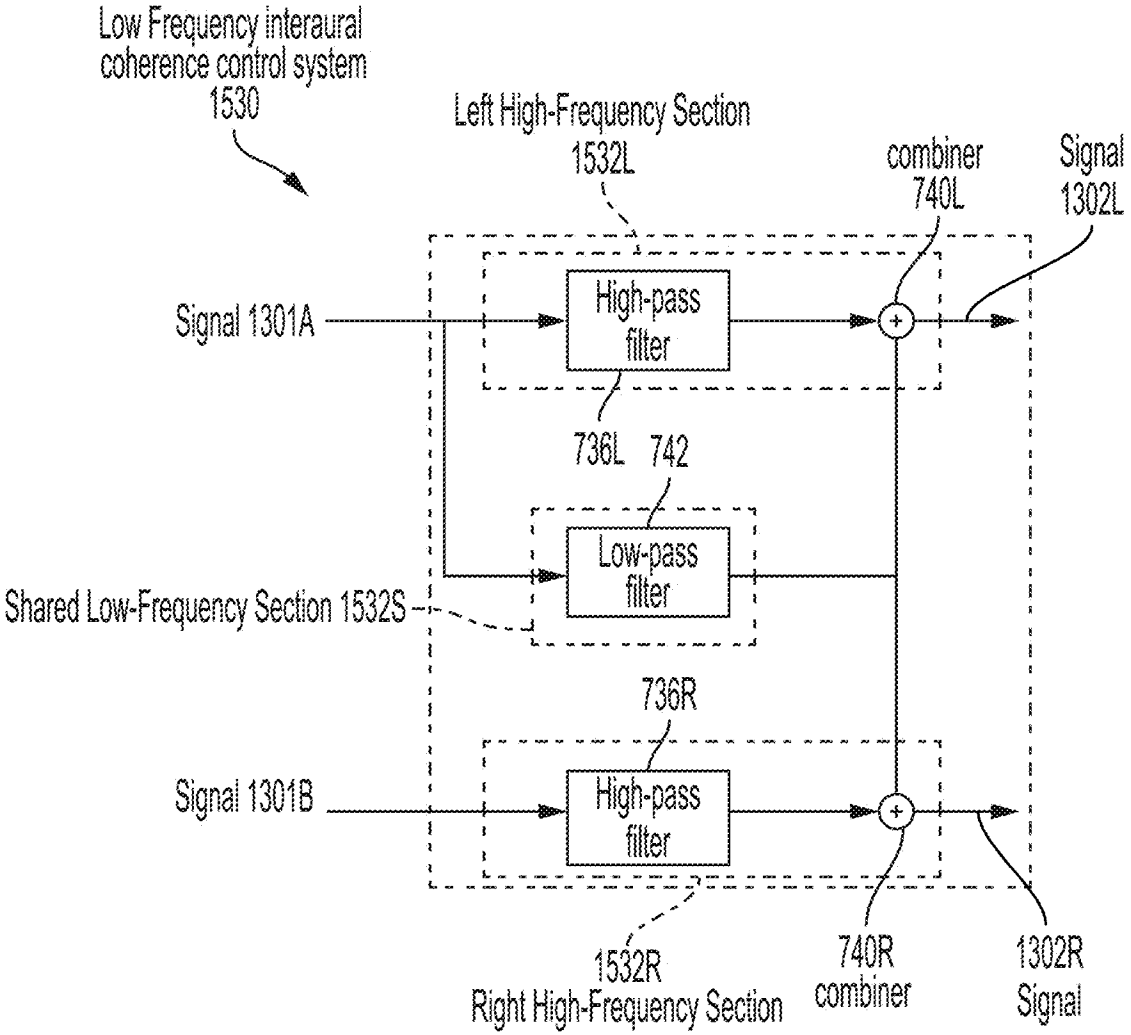
FIG. 15A illustrates a block diagram of an example low-frequency interchannel coherence control system excluding high-frequency processing units, according to some embodiments.
Figure 15B:
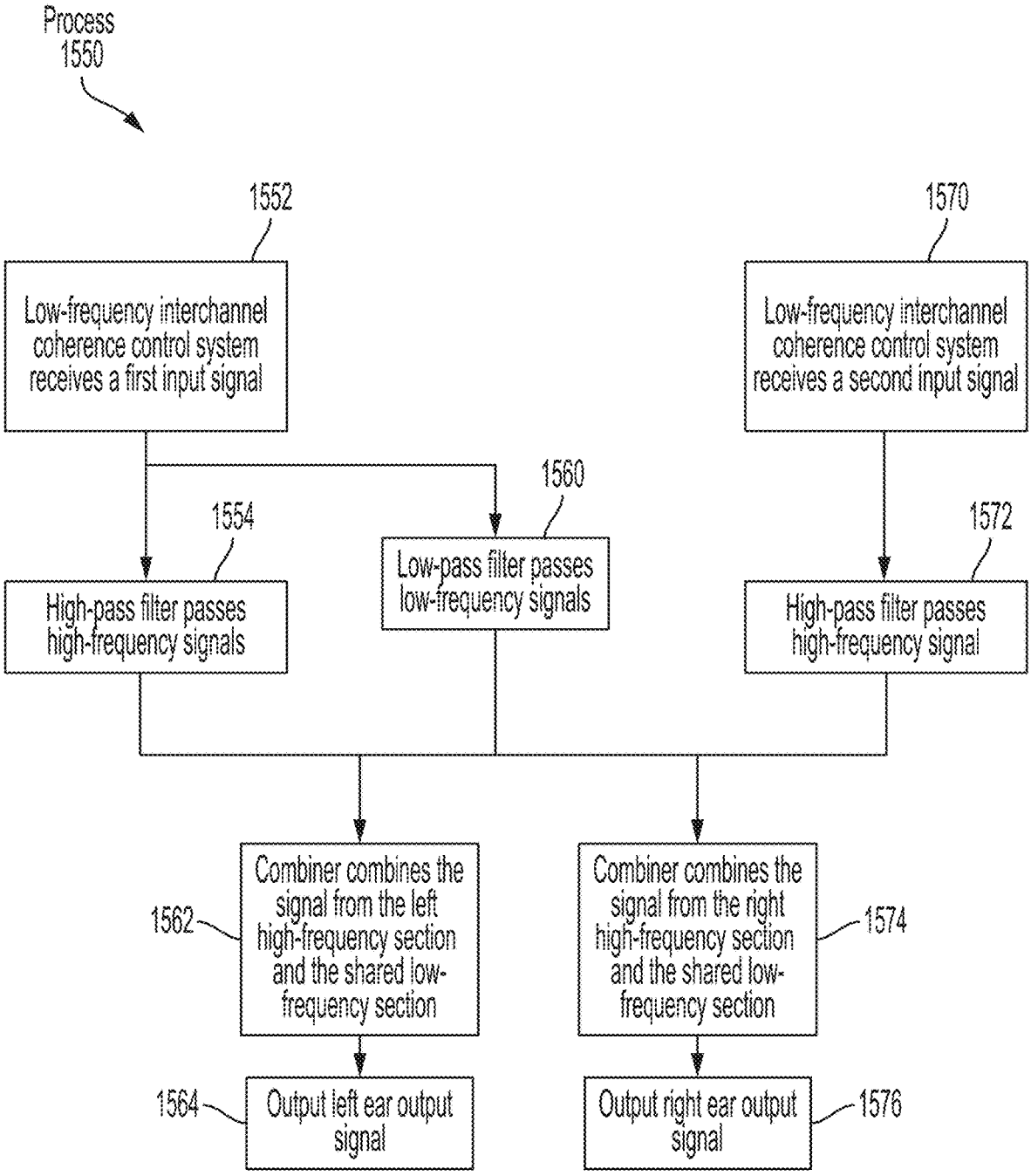
FIG. 15B illustrates a flow of an exemplary method for operating the system of FIG. 15A.

FIG. 15A illustrates a block diagram of an example low-frequency interchannel coherence control system excluding high-frequency processing units, according to some embodiments. FIG. 15B illustrates a flow of an exemplary method for operating the system of FIG. 15A.

The low-frequency interchannel coherence control system 1530 can include a left high-frequency section 1532L, a shared low-frequency section 1532S, and a right high-frequency 1532R. The left high-frequency section 1532L can include a high-pass filter 736L and a combiner 740L. Similarly, the right high-frequency section 1532R can include a high-pass filter 736R and a combiner 740R. The shared low-frequency section 1532S can include a low-pass filter 742.

In the left high-frequency section 1532L, the high-pass filter 736L receives a first input signal 1301A (step 1552 of process 1550). The high-pass filter 736L can be configured to pass signals having a frequency higher than a high-frequency threshold to the combiner 740L (step 1554). In the right high-frequency section 1532R, the high-pass filter 736R receives a second input signal 1301B (step 1570). The high-pass filter 736R can be configured to pass signals having a frequency higher than a high-frequency threshold to the combiner 740R (step 1572). In the shared high-frequency section 1532S, the low-pass filter 742 receives the first input signal 1301A (step 1560). The low-pass filter 742 can be configured to pass signals having a frequency less than a high-frequency threshold to the combiners 740L and 740R.

The combiner 740L receives signals from the high-pass filter 736L (of the left high-frequency section 1332L) and from the low-pass filter 742 (of the shared low-frequency section 1532S). The combiner 740L combines (e.g., sums) the two received signals (step 1562) and outputs a first output signal 1302L (step 1564).

The combiner 740R receives signals from the high-pass filter 736R (of the right high-frequency section 1332R) and from the low-pass filter 742 (of the shared low-frequency section 1532S). The combiner 740R combines (e.g., sums) the two received signals (step 1574) and outputs a second output signal 1302R (step 1576).

The low-frequency interchannel coherence control system 1530 of FIG. 15A may be similar to the low-frequency interaural coherence control system 1430 of FIG. 14A, with some differences. For example, the left high-frequency section 1432L and the right high-frequency section 1432R of FIG. 14A include high-frequency processing units 1337L and 1337R, respectively. The low-frequency interchannel coherence control system 1530 of FIG. 15A, on the other hand, does not include high-frequency processing units. In some embodiments, a system including the low-frequency interaural coherence control system 1530 of FIG. 15A may include high-frequency processing units in other parts of the system, for example, before the low-frequency interchannel coherence control system 1530.

Figure 16A:
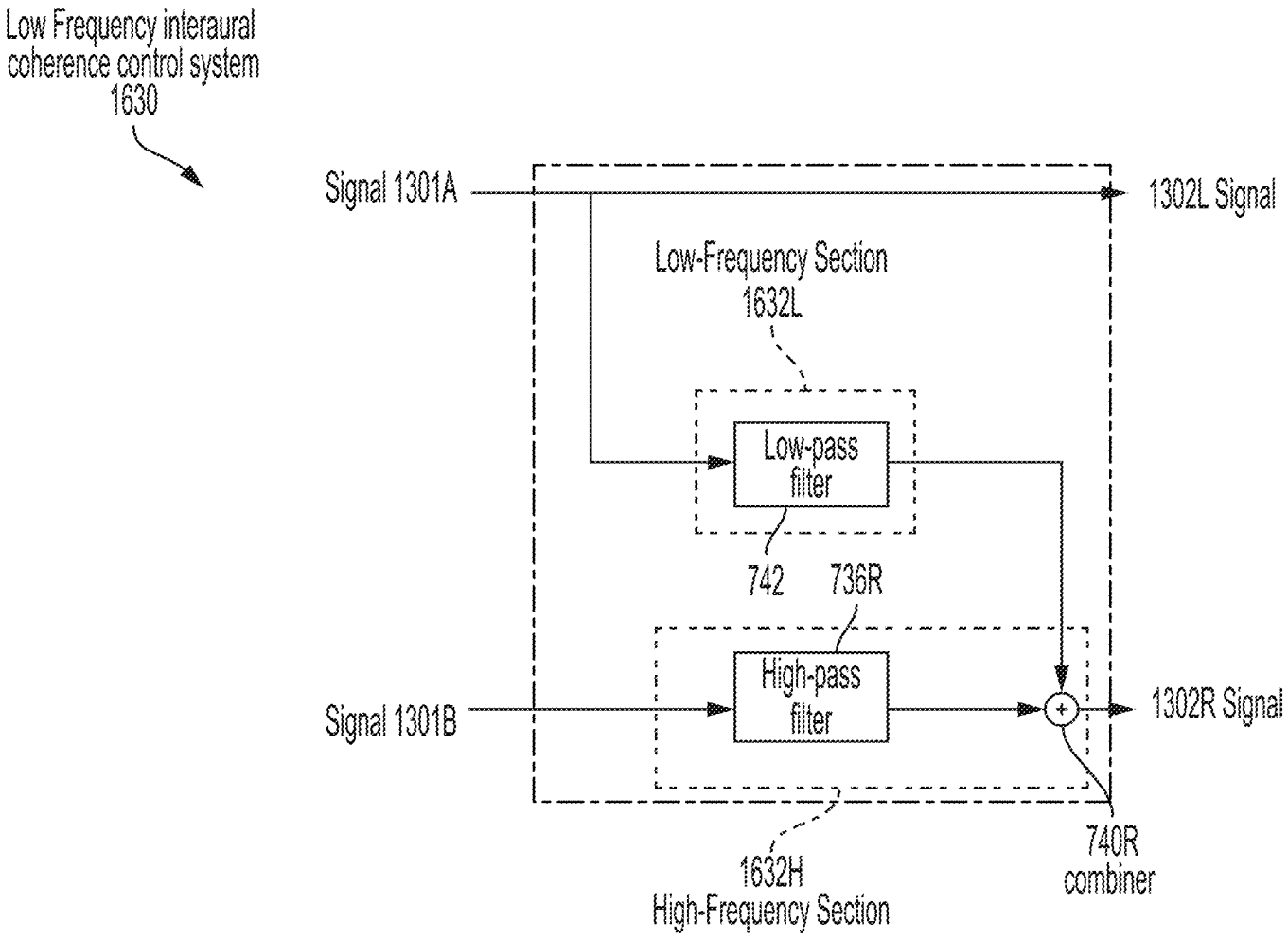
FIG. 16A illustrates a block diagram of an example low-frequency interchannel coherence control system excluding a shared-frequency section, according to some embodiments.
Figure 16B:
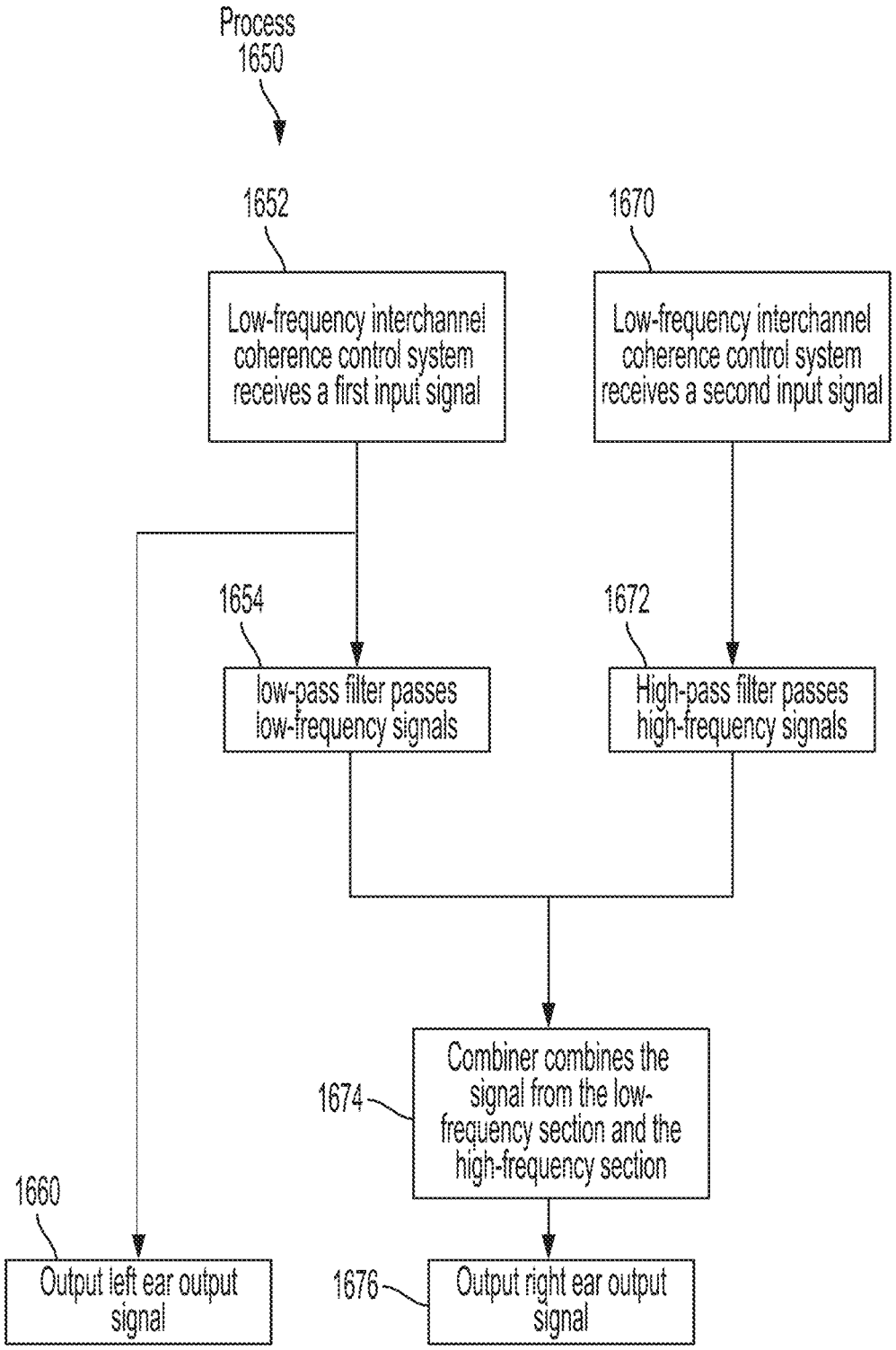
FIG. 16B illustrates a flow of an exemplary method for operating the system of FIG. 16A.

FIG. 16A illustrates a block diagram of an example low-frequency interchannel coherence control system excluding a shared-frequency section, according to some embodiments. FIG. 16B illustrates a flow of an exemplary method for operating the system of FIG. 16A.

The low-frequency interchannel coherence control system 1630 can include a low-frequency section 1632L and a high-frequency section 1632H. The low-frequency section 1632L can include a low-pass filter 742. The high-frequency section can include a high-pass filter 736 and a combiner 740.

The low-pass filter 742 of the low-frequency section 1632L can receive a first input signal 1301A (step 1652 of process 1650). The high-pass filter 736 of the high-frequency section 1632H can receive a second input signal 1301B (step 1670).

The interchannel coherence control system 1630 may directly output the first input signal 1301A as a first output signal 1302L (step 1660). In other words, the first output signal 1302L is the same as the first input signal 1301A, which means the first output signal 1302L undergoes no processing in the low-frequency interaural coherence control system 1630.

The low-pass filter 742 can be configured to pass signals having a frequency less than a low-frequency threshold to a combiner 740 (step 1654). The high-pass filter 736 can be configured to pass signals having a frequency higher than a high-frequency threshold to the combiner 740 (step 1672). The combiner 740 receives and combines (e.g., sums) signals from the low-pass filter 742 of the low-frequency section 1632L and from the high-pass filter 736 of the high-frequency section 1632H (step 1674). The combiner 740 can output the second output signal 1302R (step 1676).

A processor can process audio signals to have low-frequency coherence signals in accordance with the properties of the user's current environment. Exemplary properties include, but are not limited to, size, shape, materials, and acoustic character. For example, brick walls may cause different coherence than glass walls. As another example, the acoustic character of the sounds may differ when a couch is located in the current environment relative to when the couch is absent. The processor may use information (e.g., one or more properties) about the user's current environment to set one or more properties (e.g., the absorption coefficient) for the audio signal processing discussed above.

In some embodiments, the processor may determine the properties dynamically (e.g., computes an impulse response on the fly). For example, the system may store one or more predetermined signals in memory. The wearable head unit may generate a test audio signal and determine its response within the user's current environment. The response may be a reflected audio signal that has propagated through the user's current environment, for example. The processor may determine the properties based on changes between the test audio signal and the reflected audio signal. The reflected audio signal may be in response to the generated test audio signal.

In some embodiments, the processor may determine the properties based on one or more actions of the user. For example, the processor may determine, using the sensors on the wearable head device, whether the user has changed their gaze target, whether the user has changed their vital signs, etc. The processor may use the determined sensor information to determine which properties from the current environment would result in the user's action.

Figure 17:
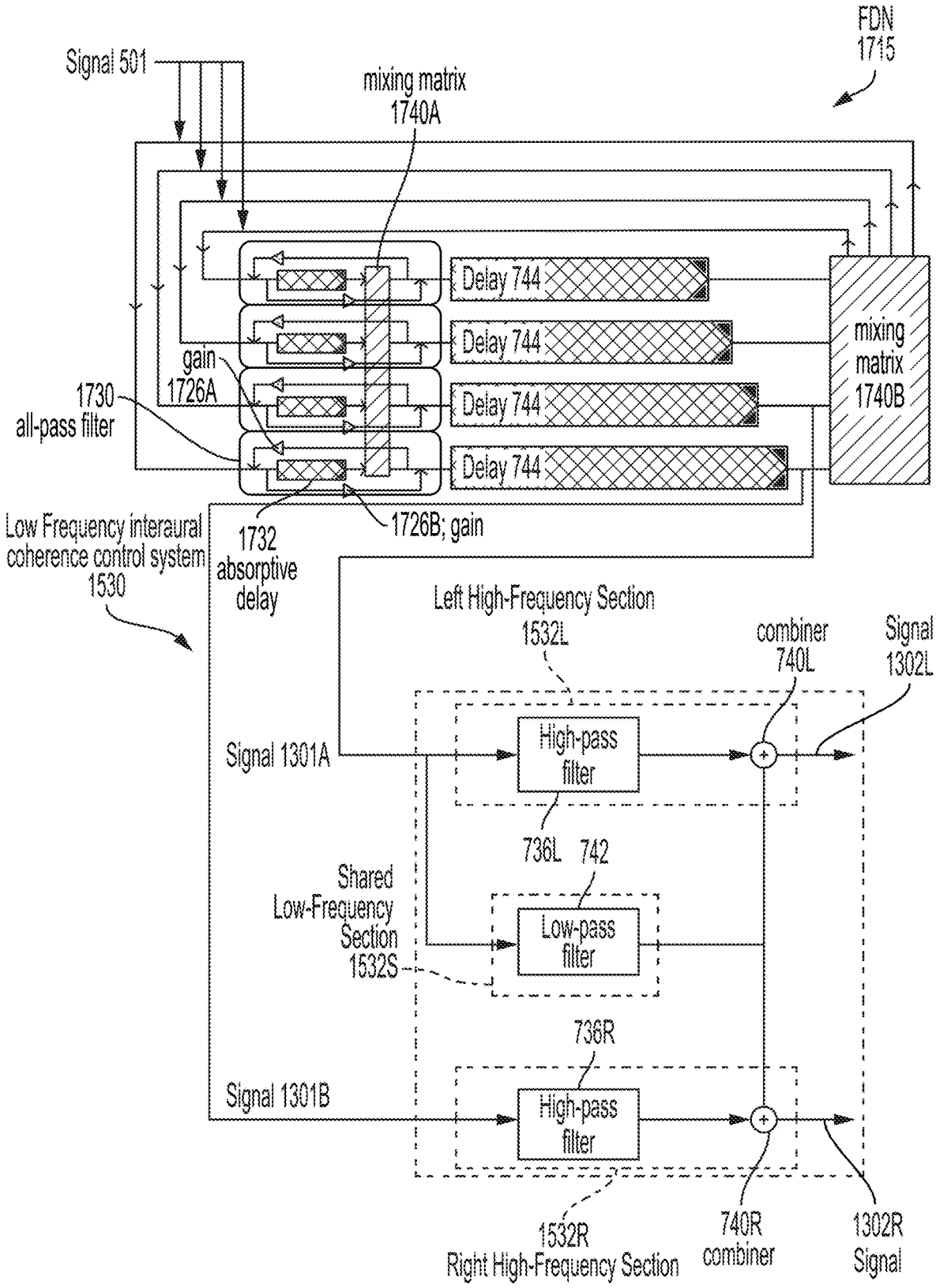
FIG. 17 illustrates an example feedback delay network (FDN) with all-pass filters and a low-frequency interchannel coherence control system, according to some embodiments.

FIG. 17 illustrates a block diagram of an example feedback delay network (FDN) including all-pass filters and a low-frequency interchannel coherence control system, according to some embodiments. The FDN 1715 can be a reverberating system that takes an input signal (e.g., a mono-input signal) and creates a multi-channel output. The multi-channel output created by the FDN 1715 may be a correct decaying reverberation signal.

FDN 1715 can include a plurality of all-pass filters 1730, a plurality of delays 1732, and a mixing matrix 1740B. The all-pass filter 1730 can include a plurality of gains 1726, an absorptive delay 1732, and another mixing matrix 1740A. The FDN 1715 may also include a plurality of combiners (not shown).

The all-pass filters 1730 receive the input signal 501 and may be configured to pass the signal 501 such that the power input to the all-pass filter 1730 can be equal to the power output from the all-pass filter 1730. In other words, each all-pass filter 1730 may have no absorption.

The absorptive delay 1732 can receive the input signal 501 and can be configured to introduce a delay in the signal. In some embodiments, the absorptive delay 1732 can delay its input signal by a number of samples. In some embodiments, each absorptive delay 1732 can have a level of absorption such that its output signal is some level less than its input signal.

The gains 1726A and 1726B can be configured to introduce a gain in its respective input signal. The input signal for the gain 1726A can be the input signal to the absorptive delay, and the output signal for the gain 1726B can be the output signal to the mixing matrix 1740A.

The output signals from the all-pass filters 1630 can be input signals to delays 1732. The delays 1732 can receive signals from the all-pass filters 1730 and can be configured to introduce delays into its respective signals. The output signals from the delays 1732 can be combined to form the output signal 502.

The output signals from the delays 1732 can also be input signals into the mixing matrix 1740B. The mixing matrix 1640B can output its signals to be fed back into the all-pass filters 1630. In some embodiments, each mixing matrix can be a full mixing matrix.

The FDN 1715 can be coupled to the low-frequency interchannel coherent control system 1530 of FIG. 15A. One of ordinary skill in the art would appreciate that the FDN may be combined with any one of the above disclosed low-frequency interchannel coherence control systems.

With respect to the systems and methods described above, elements of the systems and methods can be implemented by one or more computer processors (e.g., CPUs or DSPs) as appropriate. The disclosure is not limited to any particular configuration of computer hardware, including computer processors, used to implement these elements. In some cases, multiple computer systems can be employed to implement the systems and methods described above. For example, a first computer processor (e.g., a processor of a wearable device coupled to a microphone) can be utilized to receive input microphone signals, and perform initial processing of those signals (e.g., signal conditioning and/or segmentation, such as described above). A second (and perhaps more computationally powerful) processor can then be utilized to perform more computationally intensive processing, such as determining probability values associated with speech segments of those signals. Another computer device, such as a cloud server, can host a speech recognition engine, to which input signals are ultimately provided. Other suitable configurations will be apparent and are within the scope of the disclosure.

Although the disclosed examples have been fully described with reference to the accompanying drawings, it is to be noted that various changes and modifications will become apparent to those skilled in the art. For example, elements of one or more implementations may be combined, deleted, modified, or supplemented to form further implementations. Such changes and modifications are to be understood as being included within the scope of the disclosed examples as defined by the appended claims.

The invention claimed is:

1. A system comprising:

a low-frequency interaural coherence control system comprising:

a plurality of sections including:

a low-frequency section configured to receive a first signal, the low-frequency section including a low-pass filter configured to pass portions of an input signal to the low-frequency section, the portions passed by the low-pass filter having a frequency lower than a low-frequency threshold; and one or more high-frequency sections, the one or more high-frequency sections including a first high-frequency section configured to receive a second signal, the first high-frequency section including:

a first high-pass filter configured to pass portions of an input signal to the first high-frequency section, the portions passed by the first high-pass filter having a frequency greater than a high-frequency threshold, and a first combiner configured to receive and combine an output signal of the low-frequency section and an output signal of the first high-pass filter to generate a right ear signal; and a wearable head device configured to provide audio signals to a user, the audio signals including a left ear signal and the right ear signal, both the left ear signal and the right ear signal including spectral portions, at a frequency lower than the low-frequency threshold, from a common signal.

2. The system of claim 1, wherein the left ear signal is the first signal.

3. The system of claim 1, wherein the one or more high-frequency sections further include a second high-frequency section configured to receive the first signal, the second high-frequency section including:

a second high-pass filter configured to pass portions of the input signal to the low-frequency, the portions passed by the second high-pass filter having a frequency greater than the high-frequency threshold, and a second combiner configured to receive and combine the output signal of the low-frequency section and the output signal of the second high-pass filter to generate the left ear signal.

4. The system of claim 1, wherein at least one of the one or more high-frequency sections further includes a high-frequency processing unit, wherein the high-frequency processing unit is configured to generate an input signal to the respective high-pass filter.

5. The system of claim 1, wherein at least one of the one or more high-frequency sections further includes a high-frequency processing unit, wherein the high-frequency processing unit is configured to receive the output signal of the respective high-pass filter and generate an input signal to the respective combiner.

6. The system of claim 5, wherein the high-frequency processing unit includes an absorptive nested all-pass filter.

7. The system of claim 5, wherein the high-frequency processing unit includes a nested all-pass filter.

8. The system of claim 1, wherein the low-frequency section further includes a delay, the delay is configured to receive and introduce a delay in the passed portions of the input signal from the low-pass filter.

9. The system of claim 8, wherein the delay is an absorptive delay.

10. The system of claim 1, further comprising:

a reverberator including a plurality of comb filters, the reverberator configured to receive an input signal and output the signals to the low-frequency interaural coherence control system.

11. A method of providing audio signals to a user, the method comprising:

receiving a first signal by a low-frequency section;

filtering and passing portions of the first signal using a low-pass filter, the portions passed by the low-pass filter having a frequency lower than a low-frequency threshold;

receiving a second signal by a high-frequency section;

filtering and passing portions of the second signal using a first high-pass filter, the portions passed by the first high-pass filter having a frequency greater than a high-frequency threshold;

combining an output signal of the low-frequency section and an output signal of the first high-pass filter using a first combiner to generate a right ear signal; and providing audio signals to the user, the audio signals including a left ear signal and the right ear signal, both the left ear signal and the right ear signal including spectral portions, at a frequency lower than the low-frequency threshold, from a common signal.

12. The method of claim 11, further comprising:

outputting the first signal as a left ear signal.

13. The method of claim 11, further comprising:

filtering and passing portions of the first signal using a second high-pass filter, the portions passed by the second high-pass filter having a frequency greater than the high-frequency threshold; and combining the output signal of the low-frequency section and an output signal of the second high-pass filter using a second combiner to generate a left ear signal.

14. The method of claim 11, further comprising:

modifying a phase of the first signal or the second signal without changing a magnitude response of the first signal or the second signal, respectively, using an all-pass filter.

15. The method of claim 11, further comprising:

configuring one or more absorptive delay units with one or more absorption coefficients such that the reverberation time of the system is equal to a targeted reverberation time.

16. The method of claim 15, further comprising:

determining one or more properties of an environment; and determining the one or more absorption coefficients based on the determined one or more properties of the environment.

* * * * *